US008562191B2

(12) United States Patent
Okada et al.

(10) Patent No.: US 8,562,191 B2
(45) Date of Patent: Oct. 22, 2013

(54) VEHICLE LIGHT

(75) Inventors: Hidetaka Okada, Tokyo (JP); Takuya Matsumaru, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 262 days.

(21) Appl. No.: 13/187,112

(22) Filed: Jul. 20, 2011

(65) Prior Publication Data

US 2012/0063155 A1 Mar. 15, 2012

(30) Foreign Application Priority Data

Jul. 20, 2010 (JP) ..... 2010-162454

(51) Int. Cl.
*F21V 9/00* (2006.01)

(52) U.S. Cl.
USPC ..... 362/511; 362/520; 362/309

(58) Field of Classification Search
USPC ..... 362/511, 516, 520, 308, 309, 311.01, 362/311.06, 327, 336, 360, 555
See application file for complete search history.

(56) References Cited

U.S. PATENT DOCUMENTS 7,270,454 B2 9/2007 Amano

FOREIGN PATENT DOCUMENTS

JP 2005-203111 A 7/2005

*Primary Examiner* — Vip Patel
(74) *Attorney, Agent, or Firm* — Kenealy Vaidya LLP

(57) ABSTRACT

A vehicle light can project light beams through ring-shaped or arc-shaped light exiting surfaces, and among them the outermost and innermost light exiting surfaces are brighter than the others. The vehicle light can include a light emitting element having an optical axis and a light guide lens having an incidence surface on which light beams from the light emitting element at a certain angle (θ4 to θ5) impinge, reflection surfaces reflecting the light beams so that the light beams are parallel to each other, and light exiting surfaces configured to allow the reflected light beams to pass therethrough. In this vehicle light, light beams emitted at a certain angle (θ4 to θ4a where θ4<θ4a<θ5) can be projected through the farthest light exiting surface from the optical axis. The vehicle light can further include an incidence surface on which light beams emitted at a certain angle (θ2 to θ3 where θ2<θ3≤θ4) impinge, a reflecting surface reflecting the light beams from the incidence surface so that the light beams are parallel to each other, and a light exiting surface configured to allow the reflected light beams to pass therethrough.

8 Claims, 16 Drawing Sheets

VEHICLE LIGHT

This application claims the priority benefit under 35 U.S.C. §119 of Japanese Patent Application No. 2010-162454 filed on Jul. 20, 2010, which is hereby incorporated in its entirety by reference.

TECHNICAL FIELD

The presently disclosed subject matter relates to a vehicle light having a light emitting element as a light source, and a light guide lens for guiding light beams from the light emitting element light source.

In particular, the presently disclosed subject matter relates to a vehicle light in which the light guide lens can have a plurality of ring-shaped or arc-shaped light exiting surfaces and the outermost and innermost light exiting surfaces can be seen as having substantially the same level of brightness.

BACKGROUND ART

Conventional vehicle lights have been known to include a light emitting element as a light source, and a light guide lens configured to guide light beams from the light emitting element light source. This type of vehicle light (vehicular lamp) can be exemplified as disclosed in Japanese Patent Application Laid-Open No. 2005-203111 (or U.S. Pat. No. 7,270,454B2 corresponding thereto), in particular in FIGS. 1 to 3 of the publication. As shown in these drawings of the above publication, the vehicular lamp can have a light guide lens. The light guide lens can have a central-region incidence surface and a peripheral-region incidence surface on the rear side thereof. The central-region incidence surface can be configured to allow light beams emitted from a light emitting element light source at a smaller angle with respect to the optical axis of the light source to enter the light guide lens therethrough while the peripheral-region incidence surface can be configured to allow light beams emitted from the light source at a larger angle with respect to the optical axis to enter the light guide lens therethrough.

Further, in the vehicular lamp of the above publication, the light guide lens can have a center protruding light exiting surface on the front side thereof. The center protruding light exiting surface can be spherical like a condenser lens and configured to allow the light beams entering from the central-region incidence surface and passing through the lens to exit therethrough in the illumination direction of the vehicular lamp. In addition to these, the light guide lens can have four ring-shaped reflection surfaces and four ring-shaped light exiting surfaces. The ring-shaped reflection surface can be configured to allow the light beams from the peripheral-region incidence surface to be reflected and collimated with respect to the optical axis of the light source. The ring-shaped light exiting surface can be configured to allow the light beams reflected from the ring-shaped reflection surface to pass and exit therethrough in the illumination direction of the vehicular lamp. The four ring-shaped reflection surfaces as well as the four ring-shaped light exiting surfaces can be disposed in a stepped manner.

Specifically, a description will be given of how the light beams can be guided by the light guide lens of the vehicular lamp with reference to FIGS. 1 to 3 of the above publication (in particular, FIG. 2). For example, suppose that light beams emitted from the light emitting element light source at an angle of approximately 40 degrees with respect to the optical axis of the light source may impinge on the peripheral-region incidence surface. In this case, the light beams can be reflected by the farthest ring-shaped reflection surface among the four ring-shaped reflection surfaces with respect to the optical axis, i.e., by the outermost one. Then, the light beams can exit through the farthest ring-shaped light exiting surface among the four ring-shaped light exiting surfaces with respect to the optical axis, i.e., through the outermost one.

Further, suppose that light beams emitted from the light emitting element light source at an angle of approximately 55 degrees with respect to the optical axis of the light source may impinge on the peripheral-region incidence surface. In this case, the light beams can be reflected by the second outermost ring-shaped reflection surface among the four ring-shaped reflection surfaces. Then, the light beams can exit through the second outermost ring-shaped light exiting surface among the four ring-shaped light exiting surfaces with respect to the optical axis.

Still further, suppose that light beams emitted from the light emitting element light source at an angle of approximately 70 degrees with respect to the optical axis of the light source may impinge on the peripheral-region incidence surface. In this case, the light beams can be reflected by the third outermost (or, namely, second innermost) ring-shaped reflection surface among the four ring-shaped reflection surfaces. Then, the light beams can exit through the third outermost (or, namely, second innermost) ring-shaped light exiting surface among the four ring-shaped light exiting surfaces with respect to the optical axis.

Still further, suppose that light beams emitted from the light emitting element light source at an angle of approximately 85 degrees with respect to the optical axis of the light source may impinge on the peripheral-region incidence surface. In this case, the light beams can be reflected by the nearest (or, namely, innermost) ring-shaped reflection surface among the four ring-shaped reflection surfaces with respect to the optical axis. Then, the light beams can exit through the nearest (or, namely, innermost) ring-shaped light exiting surface among the four ring-shaped light exiting surfaces with respect to the optical axis.

Accordingly, the vehicular lamp as illustrated in FIGS. 1 to 3 (in particular, FIG. 2) of the above publication can be seen as if there are four ring-shaped bright areas or light exiting surfaces when the light guide lens is observed from the illumination direction of the vehicular lamp as shown in FIG. 3 of the above publication.

Specifically, in the vehicular lamp described in FIGS. 1 to 3 (in particular, FIG. 2) of the above publication, the farthest or outermost ring-shaped light exiting surface with respect to the optical axis of the light source can be seen as being brighter by being illuminated with the light beams emitted from the light source at an angle of approximately 40 degrees with respect to the optical axis and entering the lens, because the light beams at that angle may be strong. In this case, the light exiting area of the light guide lens of the vehicle lamp may be observed as if it is enlarged.

On the other hand, the nearest or innermost ring-shaped light exiting surface with respect to the optical axis of the light source can be seen darker by being illuminated with the light beams emitted from the light source at an angle of approximately 85 degrees with respect to the optical axis and entering the lens, because the light beams at that angle may be weak. This may generate a problem of deteriorating the uniformity in illuminance of the entire vehicular lamp.

SUMMARY

The presently disclosed subject matter was devised in view of these and other problems and features and in association with the conventional art. According to an aspect of the presently disclosed subject matter, there is provided a vehicle light having a light guide lens with a plurality of ring-shaped or arc-shaped light exiting surfaces wherein the outermost and innermost light exiting surfaces can be seen as having substantially the same level of brightness.

According to another aspect of the presently disclosed subject matter, a vehicle light can be configured to have a light guide lens with a smaller dimension in the optical axis direction thereof and to form a horizontally long light distribution pattern.

According to still another aspect (first exemplary embodiment) of the presently disclosed subject matter, a vehicle light can be configured to include a light emitting element as a light source having an optical axis and a light guide lens configured to guide light beams from the light emitting element, so as to project light in an illumination direction of the vehicle light. The light guide lens can be configured to include a first incidence surface, a second incidence surface, a first protruding light exiting surface, a plurality of first reflection surfaces, and a plurality of second light exiting surfaces. The first incidence surface can be configured to receive light beams emitted from the light emitting element at an angle of from 0 degrees to $\theta 1$ degrees (where $0<\theta 1$) with respect to the optical axis to impinge on the first incidence surface. The second incidence surface can be configured to allow light beams emitted from the light emitting element at an angle of from $\theta 4$ degrees to $\theta 5$ degrees (where $\theta 1<\theta 4<\theta 5$) with respect to the optical axis to impinge on the second incidence surface. The first protruding light exiting surface can be configured to allow the light beams having passed through the first incidence surface to exit the light guide lens through the first protruding light exiting surface in the illumination direction of the vehicle light. The plurality of first reflection surfaces can be configured to reflect the light beams having passed through the second incidence surface so that the reflected light beams are parallel with the optical axis. The plurality of second light exiting surfaces can be configured to be a ring-shaped surface or an arc-shaped surface, and to allow the reflected light beams from the plurality of first reflection surfaces to exit therethrough in the illumination direction of the vehicle light. In this vehicle light, the plurality of first reflection surfaces can be disposed in a stepped manner, and the plurality of second light exiting surfaces can be disposed in a stepped manner. In this configuration, light beams emitted from the light emitting element at an angle of from $\theta 4$ degrees to $\theta 4a$ degrees ($\theta 4<\theta 4a<\theta 5$) with respect to the optical axis of the light emitting element can impinge on the second incidence surface, and then the light beams can be reflected by the farthest first reflection surface among the plurality of first reflection surfaces with respect to the optical axis. The light beams can then exit through the farthest ring-shaped or arc-shaped second light exiting surface among the plurality of second light exiting surfaces with respect to the optical axis. Further, in this configuration, light beams emitted from the light emitting element at an angle of from $\theta 4c$ degrees to $\theta 5$ degrees (where $\theta 4a<\theta 4c<\theta 5$) with respect to the optical axis of the light emitting element can impinge on the second incidence surface, and then the light beams can be reflected by the first reflection surface nearest to the optical axis among the plurality of first reflection surfaces. The light beams can then exit through the nearest ring-shaped or arc-shaped second light exiting surface among the plurality of second light exiting surfaces with respect to the optical axis. Further, the vehicle light with this configuration can include a third incidence surface formed between the first incidence surface and the second incidence surface, wherein the third incidence surface can be configured to allow light beams emitted from the light emitting element at an angle of from $\theta 2$ degrees to $\theta 3$ degrees ($\theta 1\leq\theta 2<\theta 3\leq\theta 4$) with respect to the optical axis of the light emitting element to impinge on the third incidence surface. Further, the vehicle light with this configuration can include a second reflection surface disposed nearer to the optical axis of the light emitting element than the second incidence surface and the plurality of first incidence surfaces, wherein the second reflection surface can be configured to reflect the light beams having passed through the third incidence surface so that the reflected light beams are substantially parallel with the optical axis. Further, the vehicle light with this configuration can include a third light exiting surface disposed between the first light exiting surface and the plurality of ring-shaped or arc-shaped second light exiting surfaces, wherein the third light exiting surface can be configured to be a ring-shaped surface or an arch-shaped surface, and to allow the reflected light beams from the second reflection surface to exit through the third light exiting surface in the illumination direction of the vehicle light. Furthermore, the vehicle light can be configured such that when light beams that are emitted toward a first side (for example, upward) at an angle of $\theta 1a$ degrees ($0<\theta 1a<\theta 1$) with respect to the optical axis of the light emitting element pass through the first incidence surface and the first light exiting surface, the light beams exit the light guide lens toward the first side (for example, upward) at an angle of $\theta 1b$ degrees ($0<\theta 1b<\theta 1a$) with respect to the optical axis of the light emitting element. Furthermore, the vehicle light can be configured such that when light beams that are emitted toward a second side opposite to the first side with respect to the optical axis (for example, downward) at the angle of $\theta 1a$ degrees with respect to the optical axis of the light emitting element pass through the first incidence surface and the first light exiting surface, the light beams exit the light guide lens toward the second side (for example, downward) at the angle of $\theta 1b$ degrees with respect to the optical axis of the light emitting element. Furthermore, the vehicle light can be configured such that when light beams that are emitted toward a third side with respect to the first and second sides by 90 degrees around the optical axis (for example, leftward) at the angle of $\theta 1a$ degrees with respect to the optical axis of the light emitting element pass through the first incidence surface and the first light exiting surface, the light beams exit the light guide lens toward the third side (for example, leftward) at the angle of $\theta 1c$ degrees ($\theta 1b<\theta 1c$) with respect to the optical axis of the light emitting element. Furthermore, the vehicle light can be configured such that when light beams that are emitted toward a fourth side opposite to the third side with respect to the optical axis (for example, rightward) at the angle of $\theta 1a$ degrees with respect to the optical axis of the light emitting element pass through the first incidence surface and the first light exiting surface, the light beams exit the light guide lens toward the fourth side (for example, rightward) at the angle of $\theta 1c$ degrees with respect to the optical axis of the light emitting element. In order to achieve the above light exiting direction control, the vehicle light can be configured such that the curvature of the first light exiting surface in a plane including the direction between the third side and the fourth side and including the optical axis (for example, horizontal cross section including the optical axis) is made smaller than the curvature of the first light exiting surface in a plane including the direction between the first side and the second side and including the optical axis (for example, vertical cross section including the optical axis). In this configuration, the vehicle light can project the light beams emitted from the light emitting element at an angle of from $\theta 2$ degrees to $\theta 3$ degrees with respect to the optical axis of the light emitting element so that the ring-shaped or arc-shaped third light exiting surface nearest to the optical axis among the plurality of ring-shaped or arc-shaped second and third light exiting surfaces can be observed as being the brightest. Furthermore, in this configuration, the vehicle light can project the light beams emitted from the light emitting element at an angle of from θ4 degrees to θ4a degrees with respect to the optical axis of the light emitting element so that the ring-shaped or arc-shaped second light exiting surface farthest from the optical axis among the plurality of ring-shaped or arc-shaped second and third light exiting surfaces can be observed as being the second brightest.

Furthermore, according to another aspect of the presently disclosed subject matter, in the vehicle light with the above configuration, the second incidence surface can be configured such that the angle formed by the light beams passing through the second incidence surface and the optical axis of the light emitting element is larger than the angle formed by the light beams that impinge on the second incidence surface and the optical axis. Furthermore, the third incidence surface can be configured such that the angle formed by the light beams passing through the third incidence surface and the optical axis of the light emitting element is larger than the angle formed by the light beams that impinge on the third incidence surface and the optical axis.

Furthermore, according to still another aspect of the presently disclosed subject matter, in the vehicle light with the above configuration, the plurality of second and third light exiting surfaces each can be composed of a plurality of arc-shaped surfaces. Each of the arc-shaped surfaces can be formed by rotating a specific (corresponding) segment or curve segment around the optical axis of the light emitting element by a required angle as a center angle of the arc shape so that the light beams having passed through the plurality of second and third light exiting surfaces can form an elongated light distribution pattern, for example, a horizontally long light distribution pattern. In this case, the arc-shaped surfaces may be different in shape from one another.

Furthermore, according to still another aspect of the presently disclosed subject matter, in the vehicle light with the above configuration, the light emitting element serving as a light source can be an oval lamp type (or cannonball shape) light emitting element that includes a light emitting device and a sealing resin for sealing the light emitting device and has a shape of a spherical portion and a cylindrical trunk portion so as to be shaped into an approximately cannonball shape. Light beams exiting through the spherical portion of the sealing resin can impinge on the first incidence surface of the light guide lens, and light beams exiting through the cylindrical trunk portion can impinge on the second incidence surface and the third incidence surface of the light guide lens.

The vehicle light according to an aspect can include a light emitting element as a light source having an optical axis and a light guide lens configured to guide light beams from the light emitting element, so as to project light in an illumination direction. The light guide lens can include a first incidence surface, a second incidence surface, a first protruding light exiting surface, a plurality of first reflection surfaces, and a plurality of second light exiting surfaces. The first incidence surface can be configured to allow light beams emitted from the light emitting element at an angle of from 0 degrees to θ1 degrees (where $0<\theta1$) with respect to the optical axis to impinge thereon. The second incidence surface can be configured to allow light beams emitted from the light emitting element at an angle of from θ4 degrees to θ5 degrees (where $\theta1<\theta4<\theta5$) with respect to the optical axis to impinge thereon.

Further, in the vehicle light according to this aspect, the first protruding light exiting surface can be configured to allow the light beams having passed through the first incidence surface to exit therethrough in the illumination direction of the vehicle light. The plurality of first reflection surfaces can be configured to reflect the light beams having passed through the second incidence surface so that the reflected light beams are parallel with the optical axis.

Further, in the vehicle light according to this aspect, the plurality of second light exiting surfaces can be configured to be a ring-shaped surface or an arc-shaped surface, and to allow the reflected light beams from the plurality of first reflection surfaces to exit therethrough in the illumination direction of the vehicle light. In this vehicle light, the plurality of first reflection surfaces can be disposed in a stepped manner, and the plurality of second light exiting surfaces can be disposed in a stepped manner.

Further, in the vehicle light according to this aspect, light beams emitted from the light emitting element at an angle of from θ4 to θ4a ($\theta4<\theta4a<\theta5$) with respect to the optical axis of the light emitting element can impinge on the second incidence surface, and then the light beams can be reflected by the farthest first reflection surface among the plurality of first reflection surfaces with respect to the optical axis. The light beams can then exit through the farthest ring-shaped or arc-shaped second light exiting surface among the plurality of second light exiting surfaces with respect to the optical axis.

Further, in the vehicle light according to this aspect, light beams emitted from the light emitting element at an angle of from θ4c to θ5 ($\theta4a<\theta4c<\theta5$) with respect to the optical axis of the light emitting element can impinge on the second incidence surface, and then the light beams can be reflected by the first reflection surface nearest to the optical axis among the plurality of first reflection surfaces. The light beams can then exit through the nearest ring-shaped or arc-shaped second light exiting surface among the plurality of second light exiting surfaces with respect to the optical axis.

The vehicle light according to this aspect can be configured such that the plurality of ring-shaped or arc-shaped second light exiting surfaces can be observed as projecting light beams when the light guide lens is seen from the illumination direction of the vehicle light.

Specifically, the vehicle light according to this aspect can be configured such that the light beams emitted from the light emitting element at the angle of from θ4 to θ4a with respect to the optical axis of the light emitting element (i.e., the brighter light beams) can be projected through the ring-shaped or arc-shaped second light exiting surface farthest from the optical axis of the light emitting element (namely, outermost) among the plurality of second light exiting surfaces, so that the outermost ring-shaped or arc-shaped second light exiting surface can be observed as being the second brightest. In this case, the light exiting area of the light guide lens of the vehicle lamp according to this aspect can be advantageously observed as if it is enlarged.

On the other hand, in the vehicle light, the light beams emitted from the light emitting element at the angle of from θ4c to θ5 with respect to the optical axis of the light emitting element (i.e., the weaker light beams) may be projected through the ring-shaped or arc-shaped second light exiting surface nearest to the optical axis of the light emitting element (namely, innermost) among the plurality of second light exiting surfaces, so that the innermost ring-shaped or arc-shaped second light exiting surface can be observed as being darker among the plurality of second light exiting surfaces.

To cope with this, the vehicle light according to this aspect can include a third incidence surface formed between the first incidence surface and the second incidence surface, and the third incidence surface can be configured to allow the light beams emitted from the light emitting element at the angle of from θ2 to θ3 (θ1≤θ2<θ3≤θ4) with respect to the optical axis of the light emitting element to impinge on the third incidence surface. Further, included is a second reflection surface disposed nearer to the optical axis of the light emitting element than the second incidence surface and the plurality of first incidence surfaces, wherein the second reflection surface can be configured to reflect the light beams having passed through the third incidence surface so that the reflected light beams are substantially parallel with the optical axis.

Further, the vehicle light according to this aspect can include a third light exiting surface disposed between the first light exiting surface and the plurality of ring-shaped or arc-shaped second light exiting surfaces, wherein the third light exiting surface can be configured to be a ring-shaped surface or an arch-shaped surface, and to allow the reflected light beams from the second reflection surface to exit therethrough in the illumination direction of the vehicle light.

The vehicle light according to this aspect can make the entire light guide lens smaller in dimension in the optical axis direction as a whole than the vehicular lamp described in Japanese Patent Application Laid-Open No. 2005-203111 (in particular, see FIG. 2 of the publication) in which the incidence surface corresponding to the third incidence surface, a reflection surface corresponding to the second reflection surface, and a light exiting surface corresponding to the third light exiting surface are not provided.

Namely, according to the vehicle light this aspect, the second reflection surface can be configured to reflect the light beams emitted from the light emitting element at the angle of from θ2 degrees to θ3 degrees (θ1≤θ2<θ3≤θ4) with respect to the optical axis of the light emitting element so that the reflected light beams are substantially parallel with the optical axis. In this case, the entire light guide lens can be made smaller in dimension in the optical axis direction than the case where the second reflection surface is disposed farther from the optical axis of the light emitting element than the first reflection surface and more forward than the first reflection surface.

Specifically, in the vehicle light according to this aspect of the presently disclosed subject matter, the curvature of the first light exiting surface in, for example, horizontal cross section including the optical axis can be made smaller than the curvature of the first light exiting surface in, for example, vertical cross section including the optical axis so that: when light beams that are emitted, for example, upward at an angle of θ1a degrees (0<θ1a<θ1) with respect to the optical axis of the light emitting element pass through the first incidence surface and the first light exiting surface, the light beams exit the light guide lens upward at an angle of θ1b degrees (0<θ1b<θ1a) with respect to the optical axis of the light emitting element; when light beams that are emitted, for example, downward at the angle of θ1a degrees with respect to the optical axis of the light emitting element pass through the first incidence surface and the first light exiting surface, the light beams exit the light guide lens downward at the angle of θ1b degrees with respect to the optical axis of the light emitting element; when light beams that are emitted, for example, leftward at the angle of θ1a degrees with respect to the optical axis of the light emitting element pass through the first incidence surface and the first light exiting surface, the light beams exit the light guide lens leftward at the angle of θ1c degrees (θ1b<θ1c) with respect to the optical axis of the light emitting element; and when light beams that are emitted, for example, rightward at the angle of θ1a degrees with respect to the optical axis of the light emitting element pass through the first incidence surface and the first light exiting surface, the light beams exit the light guide lens leftward at the angle of θ1c degrees with respect to the optical axis of the light emitting element.

Accordingly, the vehicle light according to this aspect of the presently disclosed subject matter can project the light beams having passed through the first light exiting surfaces that can form a horizontally long light distribution pattern, for example.

Further, in the vehicle light according to this aspect of the presently disclosed subject matter, the light beams emitted from the light emitting element at an angle of from θ2 degrees to θ3 degrees with respect to the optical axis of the light emitting element can be projected so that the ring-shaped or arc-shaped third light exiting surface nearest to the optical axis among the plurality of ring-shaped or arc-shaped second and third light exiting surfaces can be observed as being the brightest. In addition, the light beams emitted from the light emitting element at an angle of from θ4 degrees to θ4a degrees with respect to the optical axis of the light emitting element can be projected so that the ring-shaped or arc-shaped second light exiting surface farthest from the optical axis among the plurality of ring-shaped or arc-shaped second and third light exiting surfaces can be observed as being the second brightest.

Namely, in the vehicle light according to the first aspect of the presently disclosed subject matter, the light beams emitted from the light emitting element at an angle of from θ4a degrees to θ5 degrees with respect to the optical axis of the light emitting element can be projected through the second light exiting surface disposed between the nearest ring-shaped or arc-shaped third light exiting surface and the farthest ring-shaped or arc-shaped second light exiting surface with respect to the optical axis of the light emitting element, so that the second light exiting surface can be observed as being darker than the nearest ring-shaped or arc-shaped third light exiting surface and the farthest ring-shaped or arc-shaped second light exiting surface.

In other words, the vehicle light according to the first aspect of the presently disclosed subject matter can be configured such that the innermost third light exiting surface and the outermost second light exiting surface can be observed as being brighter among the plurality of ring-shaped or arc-shaped second and third light exiting surfaces of the light guide lens.

In the vehicle light according to the other aspect of the presently disclosed subject matter, the second incidence surface can be configured such that the angle formed by the light beams passing through the second incidence surface and the optical axis of the light emitting element is larger than the angle formed by the light beams that impinge on the second incidence surface and the optical axis.

In addition, in the above vehicle light, the third incidence surface can be configured such that the angle formed by the light beams passing through the third incidence surface and the optical axis of the light emitting element is larger than the angle formed by the light beams that impinge on the third incidence surface and the optical axis.

By this configuration, the entire light guide lens can be made smaller in dimension in the optical axis direction than in the case where the light beams that impinge on the second incidence surface are not subjected to refraction by the second incidence surface so as to simply pass through the second incidence surface and the light beams that impinge on the third incidence surface are not subjected to refraction by the third incidence surface so as to simply pass through the third incidence surface.

In the vehicle light according to the other aspect of the presently disclosed subject matter, the plurality of second and third light exiting surfaces each can be composed of a plurality of arc-shaped surfaces. Each of the arc-shaped surfaces can be formed by rotating a specific (corresponding) segment or curve segment around the optical axis of the light emitting element by a required angle as a center angle of the arc shape so that the light beams having passed through the plurality of second and third light exiting surfaces can form, for example, a horizontally long light distribution pattern.

Accordingly, the vehicle light with the above configuration can form not only a horizontally long light distribution pattern with the light beams having passed through the first light exiting surface but also a horizontally long light distribution pattern with the light beams having passed through the plurality of second and third light exiting surfaces.

In the vehicle light according to the other aspect of the presently disclosed subject matter, the light emitting element serving as a light source can be an oval lamp type (or cannonball shape) light emitting element that includes a light emitting device and a sealing resin for sealing the light emitting device and has a shape of a spherical portion and a cylindrical trunk portion so as to be shaped into an approximately cannonball shape.

Specifically, light beams exiting through the spherical portion of the sealing resin can impinge on the first incidence surface of the light guide lens, and light beams exiting through the cylindrical trunk portion can impinge on the second incidence surface and the third incidence surface of the light guide lens.

Accordingly, the vehicle light with the above configuration can form a horizontally long light distribution pattern satisfying light distribution regulations with the main light beams emitted through the spherical portion of the sealing resin. Furthermore, the auxiliary light beams emitted through the cylindrical trunk portion of the sealing resin can cause the second and third light exiting surfaces of the light guide lens to be illuminated with the light as if they shine.

BRIEF DESCRIPTION OF DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

A description will now be made below to vehicle lights of the presently disclosed subject matter with reference to the accompanying drawings in accordance with exemplary embodiments.

Herein, the direction can be designated assuming that the vehicle light is installed on a vehicle body. Further, in general the illumination direction of the vehicle light and the optical axis of the light emitting element horizontally extend, and accordingly, upper, lower, left, right, front and rear directions can be determined on the basis of this orientation (see the drawings).

Figure 1A:
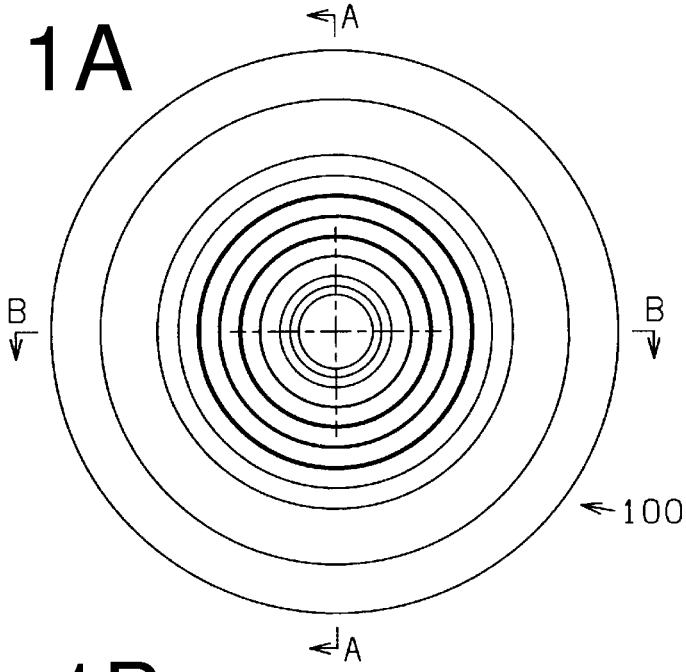
FIGS. 1A to 1C are a front view of a vehicle light 100 according to a first exemplary embodiment, a cross sectional view of the same taken along line A-A in FIG. 1A, and a cross sectional view of the same taken along line B-B in FIG. 1A, respectively.
Figure 1B:
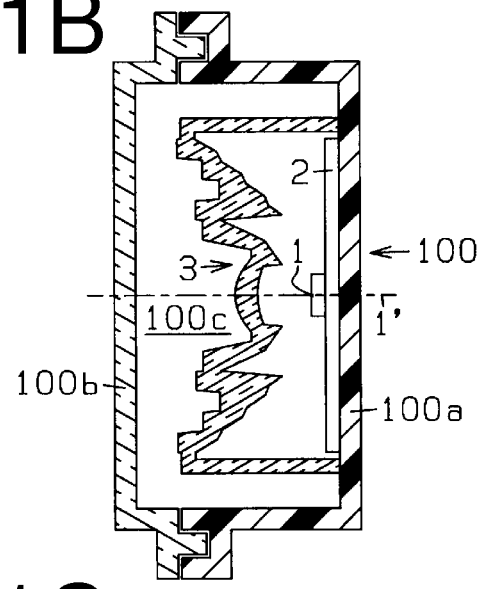
Figure 1C:
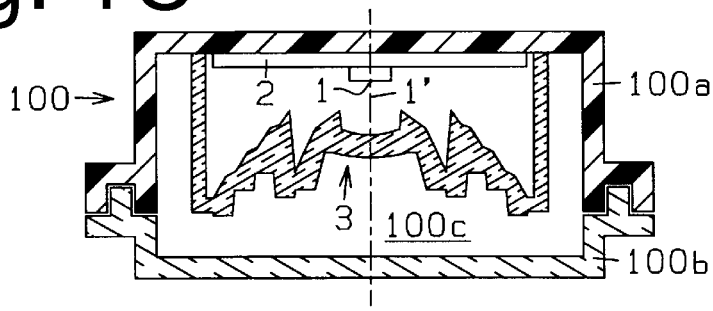

FIGS. 1A to 1C show a vehicle light 100 made in accordance with the principles of the presently disclosed subject matter. Specifically, FIG. 1A is a front view of the vehicle light 100 according to a first exemplary embodiment. FIG. 1B is a cross sectional view taken along line A-A in FIG. 1A, showing the vertical cross section of the vehicle light 100 including an optical axis 1' of a light emitting element light source 1. FIG. 1C is a cross sectional view taken along line B-B in FIG. 1A, showing the horizontal cross section of the vehicle light 100 including the optical axis 1' of a light emitting element light source 1.

Figure 2A:
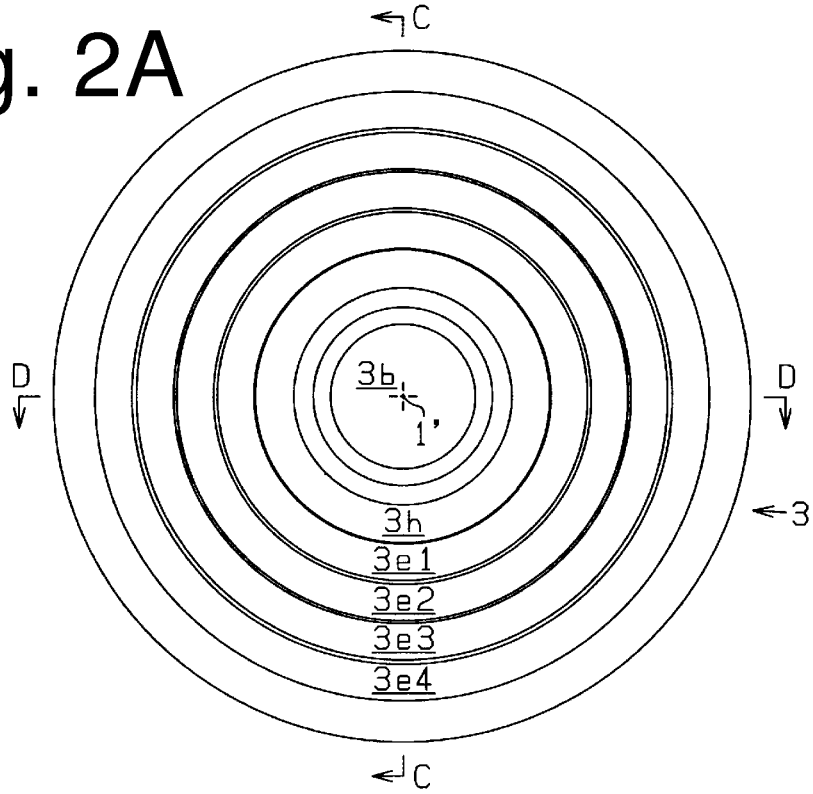
FIGS. 2A and 2B are an enlarged front view of a light guide lens 3 of the vehicle light 100 according to the first exemplary embodiment and an enlarged cross sectional view of the same taken along line C-C in FIG. 2A, respectively.
Figure 2B:
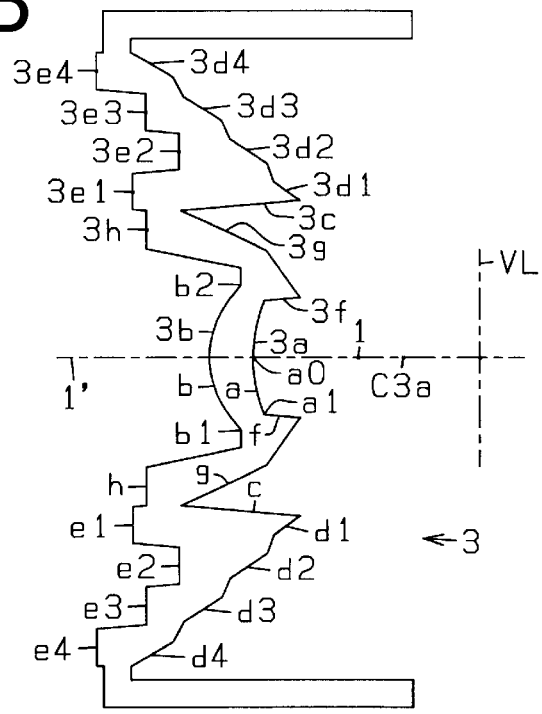
Figure 3:
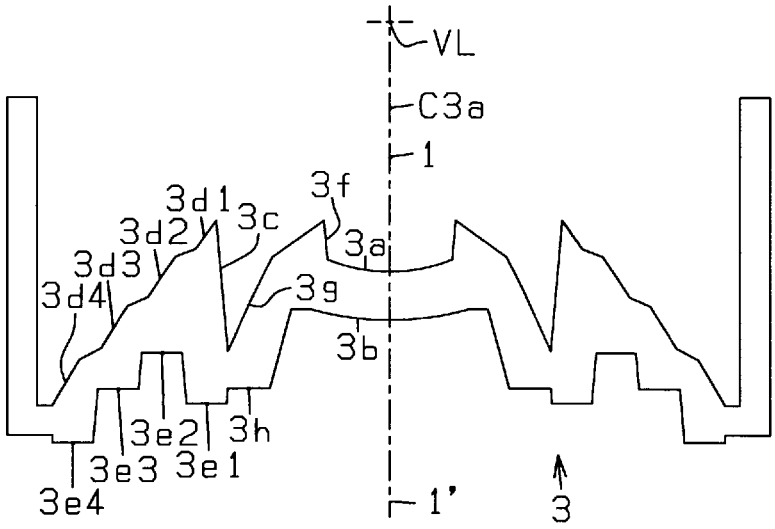
FIG. 3 is an enlarged cross sectional view of the same taken along line D-D in FIG. 2A.

FIGS. 2A to 3 show enlarged diagrams of a light guide lens 3 of the vehicle light 100 of the first exemplary embodiment. Specifically, FIG. 2A is a front view of the light guide lens 3.

FIG. 2B is a vertical cross sectional view of the same taken along line C-C in FIG. 2A, showing the vertical cross section of the light guide lens 3 including the optical axis 1' of the light emitting element light source 1. FIG. 3 is a horizontal cross sectional view of the same taken along line D-D in FIG. 2A, showing the horizontal cross section of the light guide lens 3 including the optical axis 1' of the light emitting element light source 1.

Figure 4A:
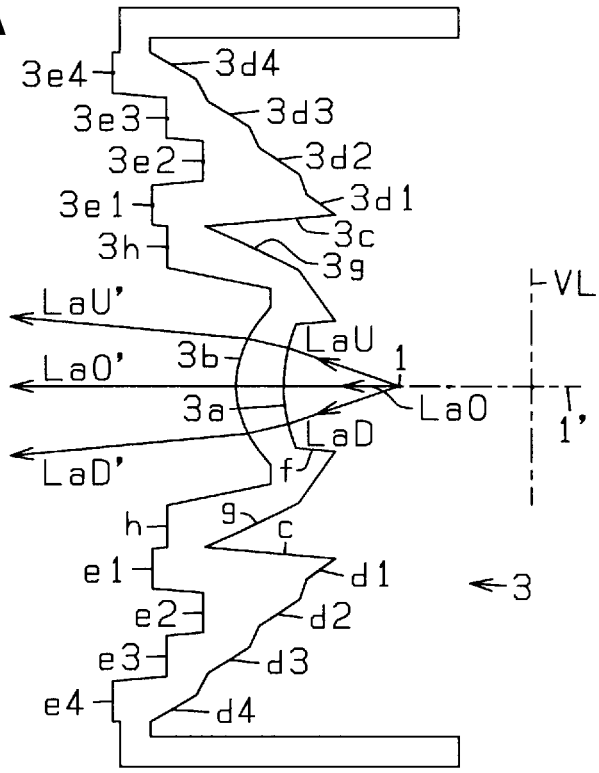
FIGS. 4A and 4B are a cross sectional view taken in a vertical direction and a cross sectional view taken in a horizontal direction, respectively, showing that light beams La0, LaU, LaD, LaL, and LaR emitted from the light emitting element light source 1 travel along respective light paths while guided by the light guide lens 3.
Figure 4B:
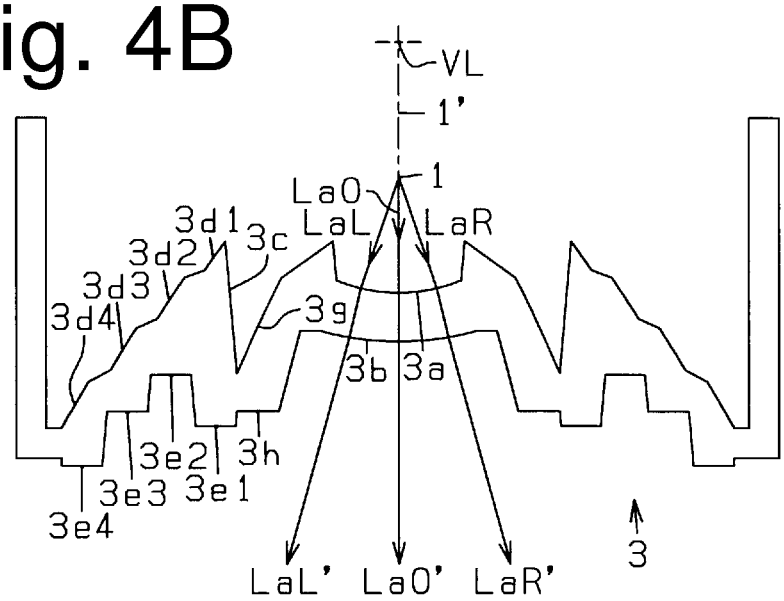

FIGS. 4A and 4B show light paths for light beams La0, LaU, LaD, LaL, and LaR emitted from the light emitting element light source 1 and guided by the light guide lens 3. Specifically, FIG. 4A is the vertical cross section of FIG. 2B including the light paths for the light beams La0, LaU, and LaD emitted from the light emitting element light source 1. FIG. 4B is the horizontal cross section of FIG. 3 including the light paths for the light beams La0, LaL, and LaR emitted from the light emitting element light source 1.

Figure 5A:
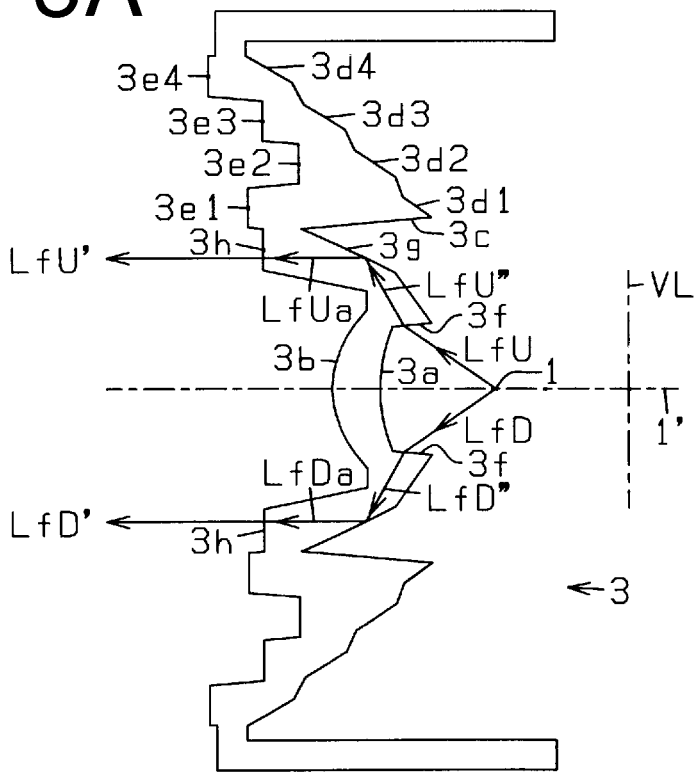
FIGS. 5A and 5B are a cross sectional view taken in a vertical direction and a cross sectional view taken in a horizontal direction, respectively, showing that light beams LfU, LfD, LfL, and LfR emitted from the light emitting element light source 1 travel along respective light paths while guided by the light guide lens 3.
Figure 5B:
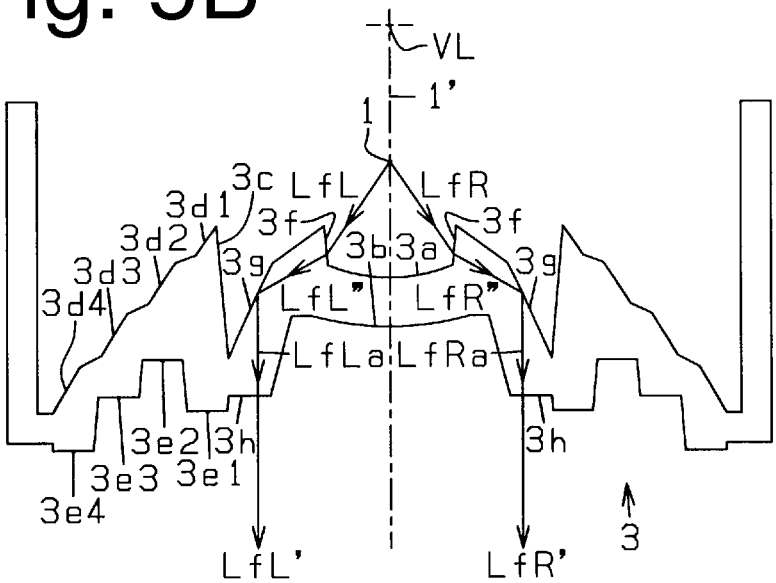

FIGS. 5A and 5B show light paths for light beams LfU, LfD, LfL, and LfR emitted from the light emitting element light source 1 and guided by the light guide lens 3. Specifically, FIG. 5A is the vertical cross section of FIG. 2B including the light paths for the light beams LfU and LfD emitted from the light emitting element light source 1. FIG. 5B is the horizontal cross section of FIG. 3 including the light paths for the light beams LfL and LfR emitted from the light emitting element light source 1.

Figure 6A:
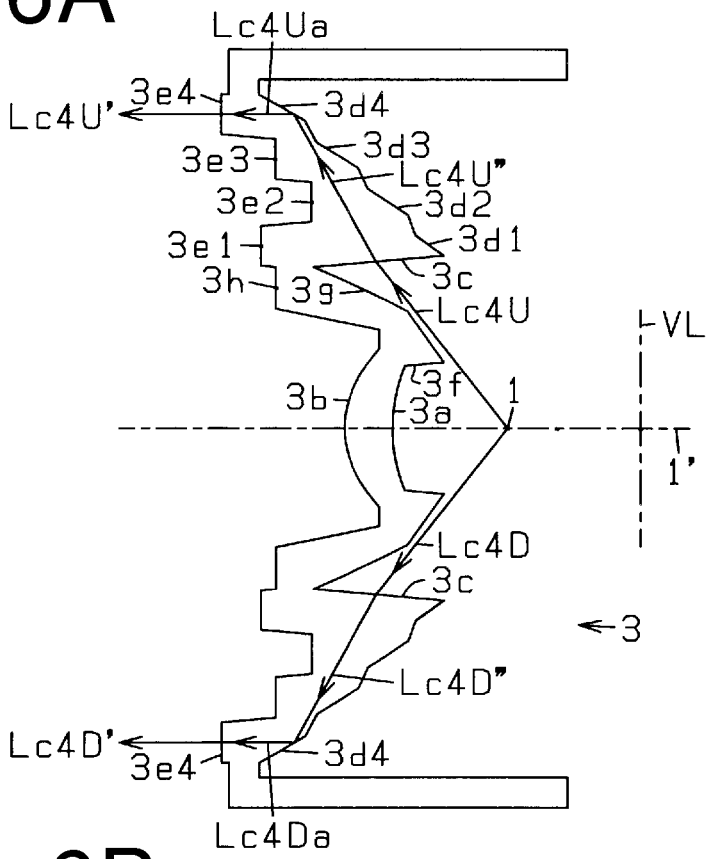
FIGS. 6A and 6B are a cross sectional view taken in a vertical direction and a cross sectional view taken in a horizontal direction, respectively, showing that light beams Lc4U, Lc4D, Lc4L, and Lc4R emitted from the light emitting element light source 1 travel along respective light paths while guided by the light guide lens 3.
Figure 6B:
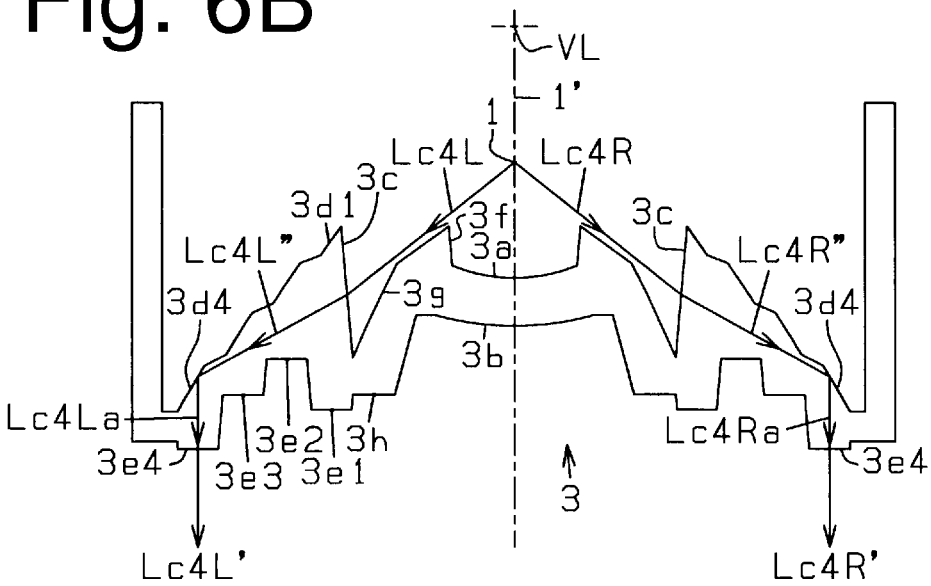

FIGS. 6A and 6B show light paths for light beams Lc4U, Lc4D, Lc4L, and Lc4R emitted from the light emitting element light source 1 and guided by the light guide lens 3. Specifically, FIG. 6A is the vertical cross section of FIG. 2B including the light paths for the light beams Lc4U and Lc4D emitted from the light emitting element light source 1. FIG. 6B is the horizontal cross section of FIG. 3 including the light paths for the light beams Lc4L and Lc4R emitted from the light emitting element light source 1.

Figure 7A:
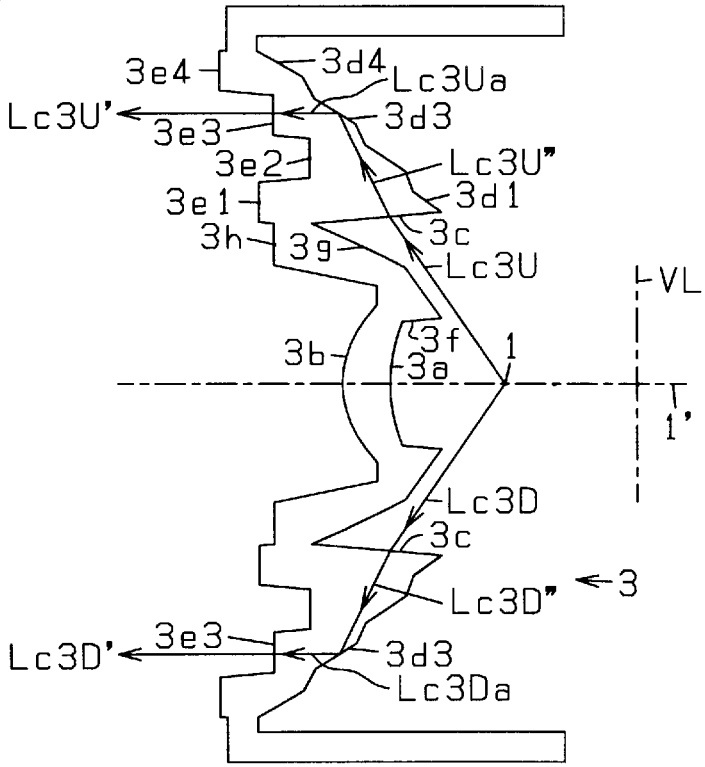
FIGS. 7A and 7B are a cross sectional view taken in a vertical direction and a cross sectional view taken in a horizontal direction, respectively, showing that light beams Lc3U, Lc3D, Lc3L, and Lc3R emitted from the light emitting element light source 1 travel along respective light paths while guided by the light guide lens 3.
Figure 7B:
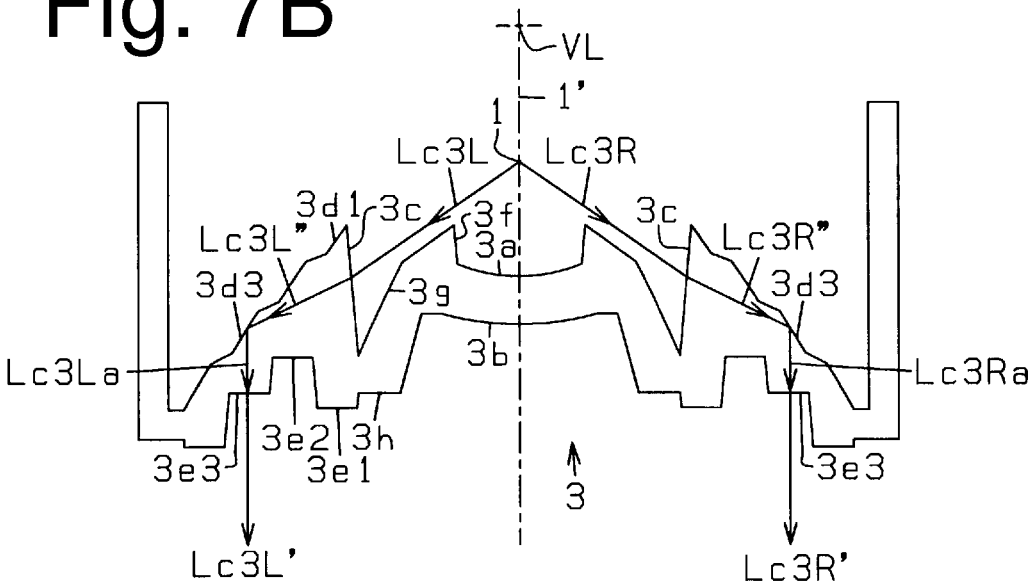

FIGS. 7A and 7B show light paths for light beams Lc3U, Lc3D, Lc3L, and Lc3R emitted from the light emitting element light source 1 and guided by the light guide lens 3. Specifically, FIG. 7A is the vertical cross section of FIG. 2B including the light paths for the light beams Lc3U and Lc3D emitted from the light emitting element light source 1. FIG. 7B is the horizontal cross section of FIG. 3 including the light paths for the light beams Lc3L and Lc3R emitted from the light emitting element light source 1.

Figure 8A:
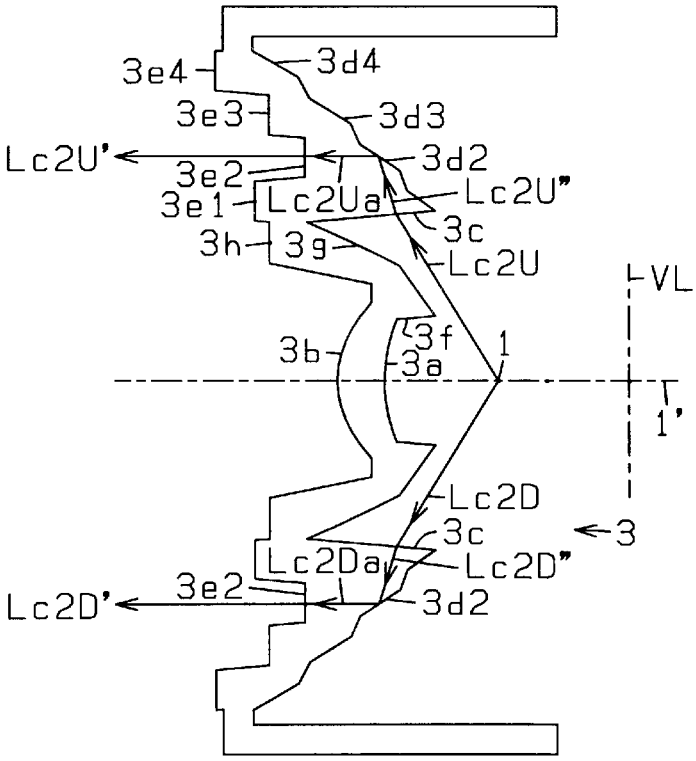
FIGS. 8A and 8B are a cross sectional view taken in a vertical direction and a cross sectional view taken in a horizontal direction, respectively, showing that light beams Lc2U, Lc2D, Lc2L, and Lc2R emitted from the light emitting element light source 1 travel along respective light paths while guided by the light guide lens 3.
Figure 8B:
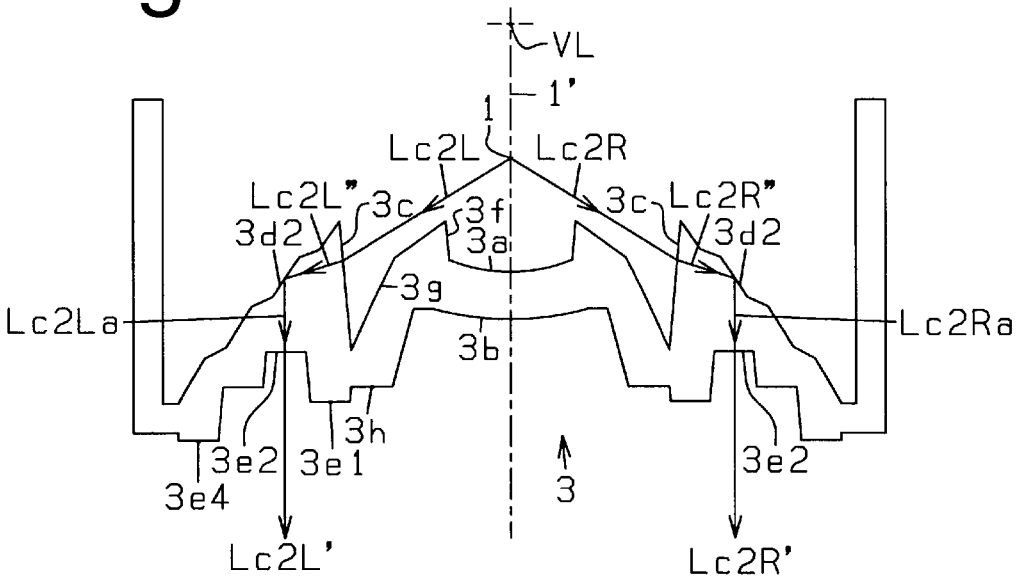

FIGS. 8A and 8B show light paths for light beams Lc2U, Lc2D, Lc2L, and Lc2R emitted from the light emitting element light source 1 and guided by the light guide lens 3. Specifically, FIG. 8A is the vertical cross section of FIG. 2B including the light paths for the light beams Lc2U and Lc2D emitted from the light emitting element light source 1. FIG. 8B is the horizontal cross section of FIG. 3 including the light paths for the light beams Lc2L and Lc2R emitted from the light emitting element light source 1.

Figure 9A:
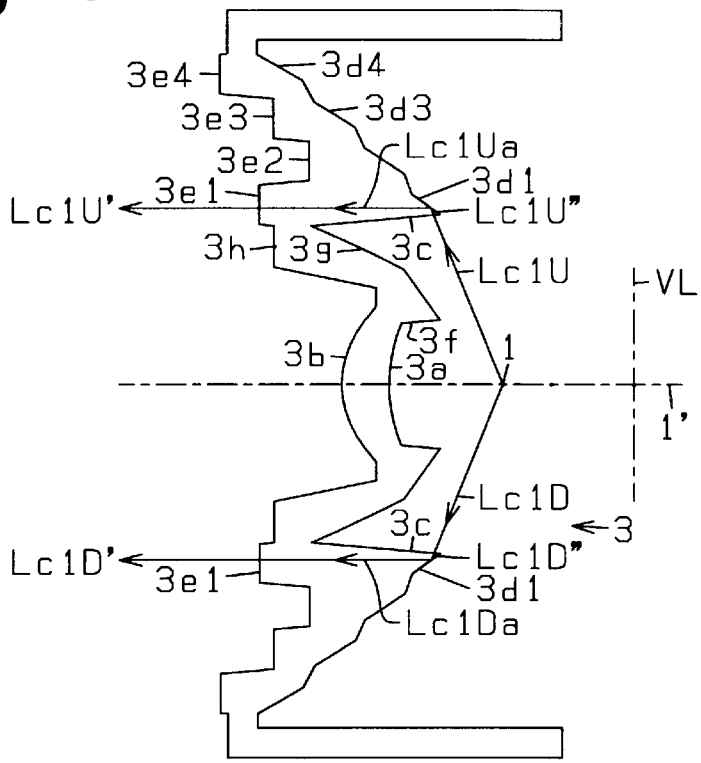
FIGS. 9A and 9B are a cross sectional view taken in a vertical direction and a cross sectional view taken in a horizontal direction, respectively, showing that light beams Lc1U, Lc1D, Lc1L, and Lc1R emitted from the light emitting element light source 1 travel along respective light paths while guided by the light guide lens 3.
Figure 9B:
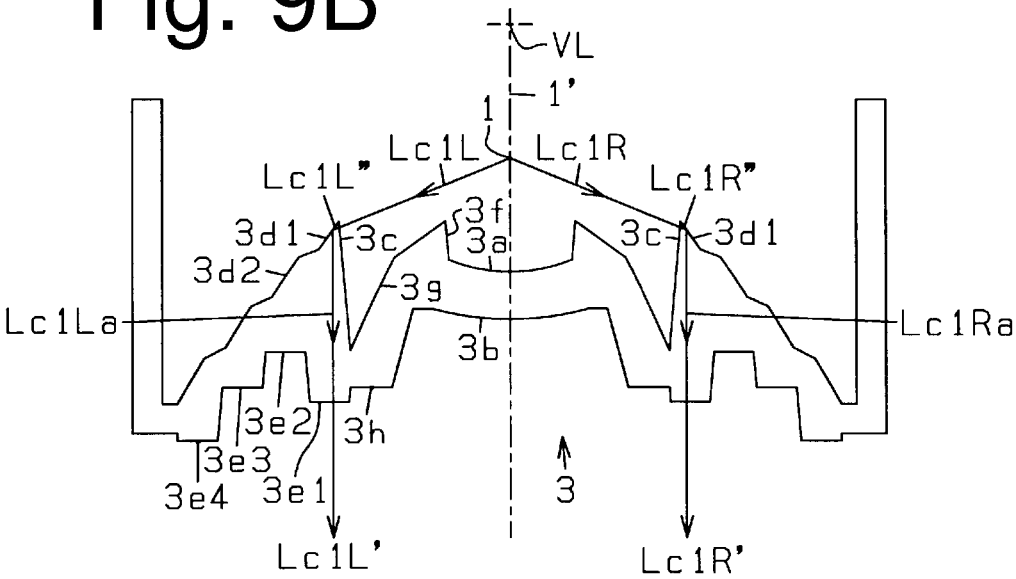
Figure 10:
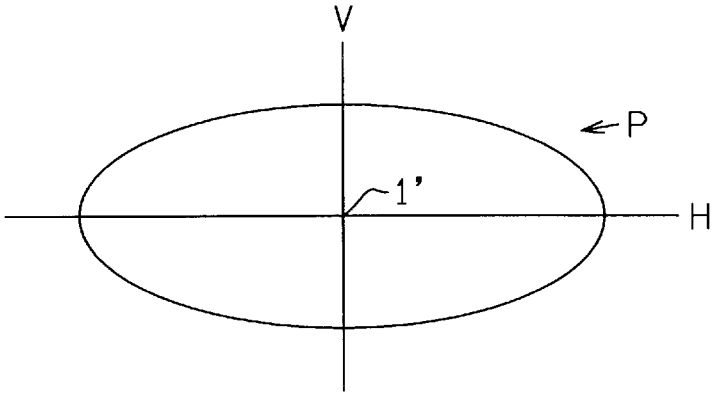
FIG. 10 is a diagram showing a horizontally long light distribution pattern P formed by light beams La0', LaU', LaD', LaL', and LaR' having passed through a light exiting surface 3*b* of the light guide lens 3.

FIGS. 9A and 9B show light paths for light beams Lc1U, Lc1D, Lc1L, and Lc1R emitted from the light emitting element light source 1 and guided by the light guide lens 3. Specifically, FIG. 9A is the vertical cross section of FIG. 2B including the light paths for the light beams Lc1U and Lc1D emitted from the light emitting element light source 1. FIG. 9B is the horizontal cross section of FIG. 3 including the light paths for the light beams Lc1L and Lc1R emitted from the light emitting element light source 1. FIG. 10 is a diagram showing a horizontally long light distribution pattern P formed by light beams La0', LaU', LaD', LaL', and LaR' having passed through a light exiting surface 3*b* of the light guide lens 3.

As shown in FIGS. 1A to 1C, the vehicle light 100 of the first exemplary embodiment can include a housing 100*a* and a cover lens 100*b* that can define a lighting chamber 100*c*, a light emitting element light source 1, for example, an LED mounted on a substrate 2, and a light guide lens 3 configured to guide light beams from the light emitting element light source 1. The light emitting element light source 1 can have an optical axis 1' and the light guide lens 3 can have a center axial line. The light emitting element light source 1 and the light guide lens 3 can be disposed such that the optical axis 1' of the light emitting element light source 1 substantially coincide with the center axial line of the light guide lens 3.

A description will be given of the light guide lens 3 of the vehicle light 100 according to the first exemplary embodiment. Specifically, with reference to FIGS. 2B and 3, the light guide lens 3 can be configured to include an incidence surface 3*a* on which light beams La0, LaU, LaD, LaL, and LaR emitted from the light emitting element light source 1 at a small angle of from 0 degrees to θ1 degrees, for example, from 0 degrees to 31 degrees, with respect to the optical axis 1' of the light emitting element light source 1 can impinge (see, for example, FIGS. 4A and 4B). Further, the incidence surface 3*a* can be formed from a curved surface obtained by rotating an arc "a" that extends from a point a0 (corresponding to the center point C3*a* on the optical axis 1' of the light emitting element light source 1) to a point a1 (see FIG. 2B) around the optical axis 1' by 360 degrees.

Although the vehicle light 100 of the first exemplary embodiment can be configured to include the incidence surface 3*a* formed from a spherically curved surface as shown in FIGS. 2B and 3, the vehicle light 100 can be configured to include an incidence surface 3*a* formed from a curved surface other than a spherical one, a flat surface, or the like, which serves as a second exemplary embodiment.

Furthermore, in the vehicle light 100 of the first exemplary embodiment, with reference to FIGS. 2B and 3, the light guide lens 3 can be configured to include an incidence surface 3*c* on which light beams Lc1U, Lc1D, Lc1L, Lc1R, Lc2U, Lc2D, Lc2L, Lc2R, Lc3U, Lc3D, Lc3L, Lc3R, Lc4U, Lc4D, Lc4L, and Lc4R emitted from the light emitting element light source 1 at a relatively large angle of from θ4 degrees to θ5 degrees, for example, from 46 degrees to 70 degrees, with respect to the optical axis 1' of the light emitting element light source 1 can impinge (see, for example, FIGS. 6A, 6B, 7A, 7B, 8A, 8B, 9A, and 9B). Further, the incidence surface 3*c* can be formed from a curved surface obtained by rotating a segment "c" around the optical axis 1' by 360 degrees (see FIG. 2B, for example). Although the vehicle light 100 of the first exemplary embodiment can be configured to include the incidence surface 3*c* obtained by rotating a segment, the vehicle light 100 can be configured to include an incidence surface 3*c* formed from a curved surface obtained by rotating a curve around the optical axis 1' by 360 degrees.

Further, with reference to FIGS. 2B and 3, the light guide lens 3 can be configured to include a protruding light exiting surface 3*b*. The protruding light exiting surface 3*b* can be configured to allow the light beams La0, LaU, LaD, LaL, and LaR having passed through the incidence surface 3*a* to exit the light guide lens 3 in the illumination direction of the vehicle light 100 (see FIGS. 4A and 4B, and in particular, the left side of FIG. 4A and the lower side of FIG. 4B). The curvature of the light exiting surface 3*b* in a horizontal cross section including the optical axis (see FIG. 3) can be made smaller than the curvature of the light exiting surface 3*b* in a vertical cross section including the optical axis (see FIG. 2B), for example. Specifically, the light exiting surface 3*b* can be formed from a curved surface obtained by rotating a curve "b" that extends from a point b1 to a point b2 (see FIG. 2B) around a line VL extending in the vertical direction by 360 degrees (see FIGS. 2A, 2B, and 3).

Accordingly, the vehicle light 100 of the first exemplary embodiment can be configured, as shown in FIG. 4A, such that when light beams LaU that are emitted upward at an angle of θ1a degrees (0<θ1a<θ1) with respect to the optical axis 1' of the light emitting element light source 1 pass through the incidence surface 3*a* and the light exiting surface 3*b*, the light beams become light beams LaU' that exit the light guide lens 3 upward at an angle of θ1b degrees (0<θ1b<θ1a) with respect to the optical axis 1' of the light emitting element light source 1. The vehicle light 100 of the first exemplary embodiment can also be configured, as shown in FIG. 4A, such that when light beams LaD that are emitted downward at the angle of θ1a degrees with respect to the optical axis 1' of the light emitting element light source 1 pass through the incidence surface 3*a* and the light exiting surface 3*b*, the light beams become light beams LaD' that exit the light guide lens 3 downward at the angle of θ1b degrees with respect to the optical axis 1' of the light emitting element light source 1.

In addition, the vehicle light 100 of the first exemplary embodiment can be configured, as shown in FIG. 4B, such that when light beams LaL that are emitted leftward at the angle of θ1a degrees with respect to the optical axis 1' of the light emitting element light source 1 pass through the incidence surface 3*a* and the light exiting surface 3*b*, the light beams become light beams LaL' that exit the light guide lens 3 leftward at an angle of θ1c degrees (θ1b<θ1c) with respect to the optical axis 1' of the light emitting element light source 1. The vehicle light 100 of the first exemplary embodiment can also be configured, as shown in FIG. 4B, such that when light beams LaR that are emitted rightward at the angle of θ1a degrees with respect to the optical axis 1' of the light emitting element light source 1 pass through the incidence surface 3*a* and the light exiting surface 3*b*, the light beams become light beams LaR' that exit the light guide lens 3 rightward at the angle of θ1c degrees with respect to the optical axis 1' of the light emitting element light source 1.

As a result, the vehicle light 100 of the first exemplary embodiment can form a horizontally long light distribution pattern P, as shown in FIG. 10, with the light beams La0', LaU', LaD', LaL', and LaR' having passed through the light exiting surface 3*b*, as shown in FIGS. 4A and 4B.

The vehicle light 100 of the first exemplary embodiment can be configured to cause the incidence surface 3*c* to refract the light beams Lc1U, Lc1D, Lc2U, Lc2D, Lc3U, Lc3D, Lc4U, and Lc4U as shown in FIGS. 6A, 7A, 8A, and 9A. As a result of this, the angles formed between the light beams Lc1U", Lc1D", Lc2U", Lc2D", Lc3U", Lc3D", Lc4D", and Lc4D" having passed through the incidence surface 3*c* and the optical axis 1' of the light emitting element light source 1 is made larger than the angles formed between the light beams Lc1U, Lc1D, Lc2U, Lc2D, Lc3U, Lc3D, Lc4D, and Lc4D impinging on the incidence surface 3*c* and the optical axis 1' of the light emitting element light source 1. Similarly, the vehicle light 100 of the first exemplary embodiment can be configured to cause the incidence surface 3*c* to refract the light beams Lc1L, Lc1R, Lc2L, Lc2R, Lc3L, Lc3R, Lc4L, and Lc4R as shown in FIGS. 6B, 7B, 8B, and 9B. As a result of this, the angles formed between the light beams Lc1L", Lc1R", Lc2L", Lc2R", Lc3L", Lc3R", Lc4L", and Lc4R" having passed through the incidence surface 3*c* and the optical axis 1' of the light emitting element light source 1 is made larger than the angles formed between the light beams Lc1L, Lc1R, Lc2L, Lc2R, Lc3L, Lc3R, Lc4L, and Lc4R impinging on the incidence surface 3*c* and the optical axis 1' of the light emitting element light source 1.

In the vehicle light 100 of the first exemplary embodiment, the light guide lens 3 can be configured to further include a reflection surface 3*d*4 having a ring shape. The reflection surface 3*d*4 can be configured to reflect the light beams Lc4U", Lc4D", Lc4L", and Lc4R" having passed through the incidence surface 3*c* so that the reflected light beams Lc4Ua, Lc4Da, Lc4La, and Lc4Ra are substantially parallel with the optical axis 1', as shown in FIGS. 6A and 6B. Further, the reflection surface 3*d*4 can be formed from a parabolic surface obtained by rotating a parabola "d4" that has a not-shown focus on the optical axis 1' of the light emitting element light source 1 around the optical axis 1' by 360 degrees (see FIG. 2B).

In the vehicle light 100 of the first exemplary embodiment, the light guide lens 3 can be configured to further include a reflection surface 3*d*3 having a ring shape. The reflection surface 3*d*3 can be configured to reflect the light beams Lc3U", Lc3D", Lc3L", and Lc3R" having passed through the incidence surface 3*c* so that the reflected light beams Lc3Ua, Lc3Da, Lc3La, and Lc3Ra are substantially parallel with the optical axis 1', as shown in FIGS. 7A and 7B. Further, the reflection surface 3*d*3 can be formed from a parabolic surface obtained by rotating a parabola "d3" that has a not-shown focus on the optical axis 1' of the light emitting element light source 1 around the optical axis 1' by 360 degrees (see FIG. 2B).

Furthermore, in the vehicle light 100 of the first exemplary embodiment, the light guide lens 3 can be configured to further include a reflection surface 3*d*2 having a ring shape. The reflection surface 3*d*2 can be configured to reflect the light beams Lc2U", Lc2D", Lc2L", and Lc2R" having passed through the incidence surface 3*c* so that the reflected light beams Lc2Ua, Lc2Da, Lc2La, and Lc2Ra are substantially parallel with the optical axis 1', as shown in FIGS. 8A and 8B. Further, the reflection surface 3*d*2 can be formed from a parabolic surface obtained by rotating a parabola "d2" that has a not-shown focus on the optical axis 1' of the light emitting element light source 1 around the optical axis 1' by 360 degrees (see FIG. 2B).

In the vehicle light 100 of the first exemplary embodiment, the light guide lens 3 can be configured to further include a reflection surface 3*d*1 having a ring shape. The reflection surface 3*d*1 can be configured to reflect the light beams Lc1U", Lc1D", Lc1L", and Lc1R" having passed through the incidence surface 3*c* so that the reflected light beams Lc1Ua, Lc1Da, Lc1La, and Lc1Ra are substantially parallel with the optical axis 1', as shown in FIGS. 9A and 9B. Further, the reflection surface 3d1 can be formed from a parabolic surface obtained by rotating a parabola "d1" that has a not-shown focus on the optical axis 1' of the light emitting element light source 1 around the optical axis 1' by 360 degrees (see FIG. 2B).

In the vehicle light 100 of the first exemplary embodiment, the reflection surfaces 3d1, 3d2, 3d3, and 3d4 can be disposed in a stepped manner while being separated in a radial direction of the light guide lens 3 (in the vertical direction in FIG. 2B and in the horizontal direction in FIG. 3). Accordingly, in the vehicle light 100 of the first exemplary embodiment, the distance between the reflected light beams Lc4Ua, Lc4Da, Lc4La, and Lc4Ra from the reflection surface 3d4 and the optical axis 1' of the light emitting element light source 1 can be set larger than in the case where the reflection surfaces are adjacent to each other without being separated in the radial direction.

Further, with reference to FIGS. 6A and 6B, the light guide lens 3 can be configured to further include a ring-shaped light exiting surface 3e4. The ring-shaped light exiting surface 3e4 can be configured to allow the reflected light beams Lc4Ua, Lc4Da, Lc4La, and Lc4Ra from the reflection surface 3d4 to pass therethrough and exit the light guide lens 3 in the illumination direction of the vehicle light 100 (see FIGS. 6A and 6B, and in particular, the left side of FIG. 6A and the lower side of FIG. 6B). Further, the light exiting surface 3e4 can be formed from a flat surface obtained by rotating a segment "e4" perpendicular to the optical axis 1' of the light emitting element light source 1 around the optical axis 1' by 360 degrees (see FIG. 2B, for example).

Further, with reference to FIGS. 7A and 7B, the light guide lens 3 can be configured to further include a ring-shaped light exiting surface 3e3. The ring-shaped light exiting surface 3e3 can be configured to allow the reflected light beams Lc3Ua, Lc3Da, Lc3La, and Lc3Ra from the reflection surface 3d3 to pass therethrough and exit the light guide lens 3 in the illumination direction of the vehicle light 100 (see FIGS. 7A and 7B, and in particular, the left side of FIG. 7A and the lower side of FIG. 7B). Further, the light exiting surface 3e3 can be formed from a flat surface obtained by rotating a segment "e3" perpendicular to the optical axis 1' of the light emitting element light source 1 around the optical axis 1' by 360 degrees (see FIG. 2B, for example).

Further, with reference to FIGS. 8A and 8B, the light guide lens 3 can be configured to further include a ring-shaped light exiting surface 3e2. The ring-shaped light exiting surface 3e2 can be configured to allow the reflected light beams Lc2Ua, Lc2Da, Lc2La, and Lc2Ra from the reflection surface 3d2 to pass therethrough and exit the light guide lens 3 in the illumination direction of the vehicle light 100 (see FIGS. 8A and 8B, and in particular, the left side of FIG. 8A and the lower side of FIG. 8B). Further, the light exiting surface 3e2 can be formed from a flat surface obtained by rotating a segment "e2" perpendicular to the optical axis 1' of the light emitting element light source 1 around the optical axis 1' by 360 degrees (see FIG. 2B, for example).

Further, with reference to FIGS. 9A and 9B, the light guide lens 3 can be configured to further include a ring-shaped light exiting surface 3e1. The ring-shaped light exiting surface 3e1 can be configured to allow the reflected light beams Lc1Ua, Lc1Da, Lc1La, and Lc1Ra from the reflection surface 3d1 to pass therethrough and exit the light guide lens 3 in the illumination direction of the vehicle light 100 (see FIGS. 9A and 9B, and in particular, the left side of FIG. 9A and the lower side of FIG. 9B). Further, the light exiting surface 3e1 can be formed from a flat surface obtained by rotating a segment "e1" perpendicular to the optical axis 1' of the light emitting element light source 1 around the optical axis 1' by 360 degrees (see FIG. 2B, for example).

In the vehicle light 100 of the first exemplary embodiment, the light exiting surfaces 3e1, 3e2, 3e3, and 3e4 can be disposed in a stepped manner while being separated in the direction of the optical axis 1' (in the horizontal direction in FIG. 2B and in the vertical direction in FIG. 3). Accordingly, in the vehicle light 100 of the first exemplary embodiment, the diameter of the light exiting surface 3e4 can be made larger than in the case where the light exiting surfaces are not separated in the optical axis direction. Furthermore, the distance between the reflection surface 3d1 and the light exiting surface 3e1 (lens thickness), the distance between the reflection surface 3d2 and the light exiting surface 3e2 (lens thickness), and the distance between the reflection surface 3d3 and the light exiting surface 3e3 (lens thickness) can be made smaller than in the case where the light exiting surfaces 3e1, 3e2, and 3e3 are coplanar with the light exiting surface 3e4.

In the vehicle light 100 of the first exemplary embodiment, although 4 sets of the reflection surface 3d1, 3d2, 3d3, 3d4 and the light exiting surface 3e1, 3e2, 3e3, 3e4 are formed, any number of sets of the reflection surface 3d1, , , , and the light exiting surface 3e1, , , , may be formed, which serves as a fourth exemplary embodiment.

In the vehicle light 100 of the first exemplary embodiment, when the light beams Lc4U, Lc4D, Lc4L, and Lc4R emitted from the light emitting element light source 1 at an angle of from θ4 degrees to θ4a degrees (θ4<θ4a) with respect to the optical axis 1' of the light emitting element light source 1 impinge on the incidence surface 3c as shown in FIGS. 6A and 6B, the light beams can be reflected by the ring-shaped reflection surface 3d4 farthest from the optical axis 1' among the plurality of reflection surfaces 3d1, 3d2, 3d3, and 3d4. Then, the light beams can exit through the ring-shaped light exiting surface 3e4 farthest from the optical axis 1' to become exiting light beams Lc4U', Lc4D', Lc4L', and Lc4R'.

In the vehicle light 100 of the first exemplary embodiment, when the light beams Lc3U, Lc3D, Lc3L, and Lc3R emitted from the light emitting element light source 1 at an angle of from θ4a degrees to θ4b degrees (θ4a<θ4b) with respect to the optical axis 1' of the light emitting element light source 1 impinge on the incidence surface 3c as shown in FIGS. 7A and 7B, the light beams can be reflected by the ring-shaped reflection surface 3d3 second farthest from the optical axis 1' among the plurality of reflection surfaces 3d1, 3d2, 3d3, and 3d4. Then, the light beams can exit through the ring-shaped light exiting surface 3e3 second farthest from the optical axis 1' to become exiting light beams Lc3U', Lc3D', Lc3L', and Lc3R'.

Further, in the vehicle light 100 of the first exemplary embodiment, when the light beams Lc2U, Lc2D, Lc2L, and Lc2R emitted from the light emitting element light source 1 at an angle of from θ4b degrees to θ4c degrees (θ4b<θ4c) with respect to the optical axis 1' of the light emitting element light source 1 impinge on the incidence surface 3c as shown in FIGS. 8A and 8B, the light beams can be reflected by the ring-shaped reflection surface 3d2 third farthest from the optical axis 1' among the plurality of reflection surfaces 3d1, 3d2, 3d3, and 3d4. Then, the light beams can exit through the ring-shaped light exiting surface 3e2 third farthest from the optical axis 1' to become exiting light beams Lc2U', Lc2D', Lc2L', and Lc2R'.

In the vehicle light 100 of the first exemplary embodiment, when the light beams Lc1U, Lc1D, Lc1L, and Lc1R emitted from the light emitting element light source 1 at an angle of from θ4c degrees to θ5 degrees (θ4c<θ5) with respect to the optical axis 1' of the light emitting element light source 1 impinge on the incidence surface 3*c* as shown in FIGS. 9A and 9B, the light beams can be reflected by the ring-shaped reflection surface 3*d*4 nearest to the optical axis 1' among the plurality of reflection surfaces 3*d*1, 3*d*2, 3*d*3, and 3*d*4. Then, the light beams can exit through the ring-shaped light exiting surface 3*e*1 nearest to the optical axis 1' to become exiting light beams Lc1U', Lc1D', Lc1L', and Lc1R'.

In the above vehicle light 100 of the first exemplary embodiment, as shown in FIGS. 1A and 2A, the plurality of ring-shaped light exiting surfaces 3*e*1, 3*e*2, 3*e*3, and 3*e*4 can be observed as to project light beams when the light guide lens 3 is seen from the illumination direction of the vehicle light 100. Specifically, in the vehicle light 100 of the first exemplary embodiment, the light beams Lc4U, Lc4D, Lc4L, and Lc4R emitted from the light emitting element at the angle of from θ4 to θ4a with respect to the optical axis 1' of the light emitting element light source 1 (i.e., the brighter light beams, and as shown in FIGS. 6A and 6B) can be projected through the ring-shaped light exiting surface 3*e*4 farthest from the optical axis 1' of the light emitting element 1 (namely, outermost) among the plurality of light exiting surfaces 3*e*1, 3*e*2, 3*e*3, and 3*e*4, so that the outermost ring-shaped light exiting surface 3*e*4 can be observed as being the second brightest. In this case, the light exiting area of the light guide lens 3 of the vehicle lamp 100 according to the first exemplary embodiment can be advantageously observed as if it is enlarged.

On the other hand, in the vehicle light 100 of the first exemplary embodiment, when the light guide lens 3 is observed from the illumination direction of the vehicle light 100 as shown in FIGS. 1A and 2A, the light beams Lc1U, Lc1D, Lc1L, and Lc1R emitted from the light emitting element light source 1 at the angle of from θ4c to θ5 with respect to the optical axis 1' of the light emitting element light source 1 (i.e., the weaker light beams) may be projected through the ring-shaped light exiting surface 3*e*1 nearest to the optical axis 1' of the light emitting element light source 1 (namely, innermost) among the plurality of light exiting surfaces 3*e*1, 3*e*2, 3*e*3, and 3*e*4, so that the innermost ring-shaped light exiting surface 3*e*1 can be observed as being darker among the plurality of light exiting surfaces 3*e*1, 3*e*2, 3*e*3, and 3*e*4.

To cope with this, the vehicle light 100 of the first exemplary embodiment can include the incidence surface 3*f* formed between the incidence surface 3*a* and the incidence surface 3*c*, and the incidence surface 3*f* can be configured to allow the light beams LfU, LfD, LfL, and LfR emitted from the light emitting element light source 1 at the mid-range angle of from θ2 to θ3 (θ1≤θ2<θ3≤θ4) or for example 31 degrees to 46 degrees with respect to the optical axis 1' of the light emitting element light source 1 to impinge on the incidence surface 3*f* (see FIGS. 5A and 5B). Specifically, the incidence surface 3*f* can be formed from a curved surface obtained by rotating a segment "f" around the optical axis 1' by 360 degrees (see FIG. 2B, for example). Although the vehicle light 100 of the first exemplary embodiment can be configured to include the incidence surface 3*f* obtained by rotating a segment, the vehicle light 100 can be configured to include an incidence surface 3*f* formed from a curved surface obtained by rotating a curve (not shown) around the optical axis 1' by 360 degrees.

Further, as shown in FIGS. 2B and 3, the vehicle light 100 of the first exemplary embodiment can be configured to include a ring-shaped reflection surface 3*g* disposed nearer to the optical axis 1' of the light emitting element light source 1 than the incidence surface 3*c* and the plurality of reflection surfaces 3*d*1, 3*d*2, 3*d*3, and 3*d*4, and the reflection surface 3*g* can be configured to reflect the light beams LfU", LfD", LfL", and LfR" having passed through the incidence surface 3*f* so that the reflected light beams LfUa, LfDa, LfLa, and LfRa are substantially parallel with the optical axis 1' (see FIGS. 5A and 5B). Specifically, the refection surface 3*g* can be formed from a parabolic surface obtained by rotating a parabola "g" that has a not-shown focus on the optical axis 1' of the light emitting element light source 1 around the optical axis 1' by 360 degrees (see FIG. 2B).

Further, the vehicle light 100 according to the first exemplary embodiment can include a light exiting surface 3*h* disposed between the light exiting surface 3*b* and the plurality of ring-shaped light exiting surfaces 3*e*1, 3*e*2, 3*e*3, and 3*e*4, wherein the light exiting surface 3*h* can be configured to be a ring-shaped surface, and to allow the reflected light beams LfUa, LfDa, LfLa, and LfRa from the reflection surface 3*g* to exit therethrough in the illumination direction of the vehicle light 100 (see FIGS. 5A and 5B, and in particular, the left side of FIG. 5A and the lower side of FIG. 5B). Specifically, the light exiting surface 3*h* can be formed from a flat surface obtained by rotating a segment "h" that is perpendicular to the optical axis 1' of the light emitting element light source 1 (see FIG. 2B) around the optical axis 1' by 360 degrees.

In this case, the entire light guide lens 3 can be made smaller in dimension in the optical axis 1' direction than the vehicular lamp disclosed in Japanese Patent Application Laid-Open No. 2005-203111 (in particular, see FIG. 2) that does not have an incidence surface 3*f*, a reflection surface 3*g*, and a light exiting surface 3*h* (see FIGS. 2A, 5A and 5B). Namely, in the vehicle light 100 of the first exemplary embodiment, the entire light guide lens 3 can be made smaller in dimension in the optical axis 1' direction than in the case where the reflection surface 3*g* for reflecting the light beams LfU, LfD, LfL, and LfR emitted from the light emitting element light source 1 at an angle of from θ2 degrees to θ3 degrees (θ1≤θ2<θ3≤θ4) with respect to the optical axis 1' of the light emitting element light source 1 to generate reflected light beams LfUa, LfDa, LfLa, and LfRa parallel with the optical axis 1' is disposed farther from the optical axis 1' and more forward than the reflection surface 3*d*4 (see the left side of FIG. 5A and the lower side of FIG. 5B).

In the vehicle light 100 of the first exemplary embodiment, when the light guide lens 3 is observed from the illumination direction of the vehicle light 100 as shown in FIG. 2A, the light beams LfU, LfD, LfL, and LfR emitted from the light emitting element light source 1 at the angle of from θ2 to θ3 with respect to the optical axis 1' of the light emitting element light source 1 can be projected through the ring-shaped light exiting surface 3*h* nearest to the optical axis 1' of the light emitting element light source 1 among the plurality of light exiting surfaces 3*e*1, 3*e*2, 3*e*3, and 3*e*4 and the ring-shaped light exiting surface 3*h*, so that the innermost ring-shaped light exiting surface 3*h* can be observed as being the brightest among them. In addition, when the light guide lens 3 is observed from the illumination direction of the vehicle light 100 as shown in FIG. 2A, the light beams Lc4U, Lc4D, Lc4L, and Lc4R emitted from the light emitting element light source 1 at the angle of from θ4 to θ4a with respect to the optical axis 1' of the light emitting element light source 1 can be projected through the ring-shaped light exiting surface 3*e*4 farthest from the optical axis 1' of the light emitting element light source 1 among the plurality of light exiting surfaces 3*e*1, 3*e*2, 3*e*3, and 3*e*4 and the ring-shaped light exiting surface 3*h*, so that the outermost ring-shaped light exiting surface 3*e*4 can be observed as being the second brightest among them.

Accordingly, when the light guide lens 3 is observed from the illumination direction of the vehicle light 100 as shown in FIG. 2A, the light beams Lc1U, Lc1D, Lc1L, Lc1R, Lc2U, Lc2D, Lc2L, Lc2R, Lc3U, Lc3D, Lc3L, and Lc3R emitted from the light emitting element light source 1 at the angle of from θ4a to θ5 with respect to the optical axis 1' of the light emitting element light source 1 (see FIGS. 7A, 7B, 8A, 8B, 9A, and 9B) can be projected through the light exiting surfaces 3*e*1, 3*e*2, and 3*e*3 disposed between the nearest ring-shaped light exiting surface 3*h* and the farthest ring-shaped light exiting surface 3*e*4. Accordingly, these light exiting surfaces 3*e*1, 3*e*2, and 3*e*3 can be observed as being darker than the light exiting surfaces 3*h* and 3*e*4.

As a result, when the vehicle light 100 of the first exemplary embodiment can be observed from its illumination direction, both the innermost light exiting surface 3*h* and the outermost light exiting surface 3*e*4 can be observed as being brighter than the other ring-shaped light exiting surface 3*e*1, 3*e*2, and 3*e*3.

Furthermore, the vehicle light 100 of the first exemplary embodiment can be configured, as shown in FIG. 5A, to cause the incidence surface 3*f* to refract the light beams LfU and LfD from the light emitting element light source 1. As a result of this, the angle formed between the light beams LfU", LfD" having passed through the incidence surface 3*f* and the optical axis 1' of the light emitting element light source 1 is made larger than the angle formed between the light beams LfU, LfD that impinge on the incidence surface 3*f* and the optical axis 1'. Likewise, as shown in FIG. 5B, the vehicle light 100 can be configured to cause the incidence surface 3*f* to refract the light beams LfL and LfR from the light emitting element light source 1. As a result of this, the angle formed between the light beams LfL", LfR" having passed through the incidence surface 3*f* and the optical axis 1' of the light emitting element light source 1 is made larger than the angle formed between the light beams LfL, LfR that impinge on the incidence surface 3*f* and the optical axis 1'.

Figure 11A:
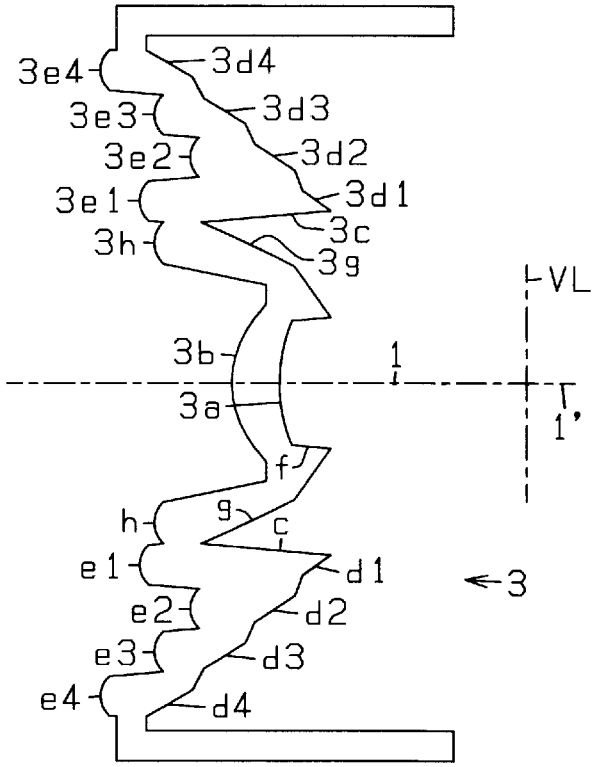
FIGS. 11A and 11B are an enlarged cross sectional view taken in a vertical direction and an enlarged cross sectional view taken in a horizontal direction, respectively, showing a light guide lens 3 of a vehicle light 100 according to a sixth exemplary embodiment.
Figure 11B:
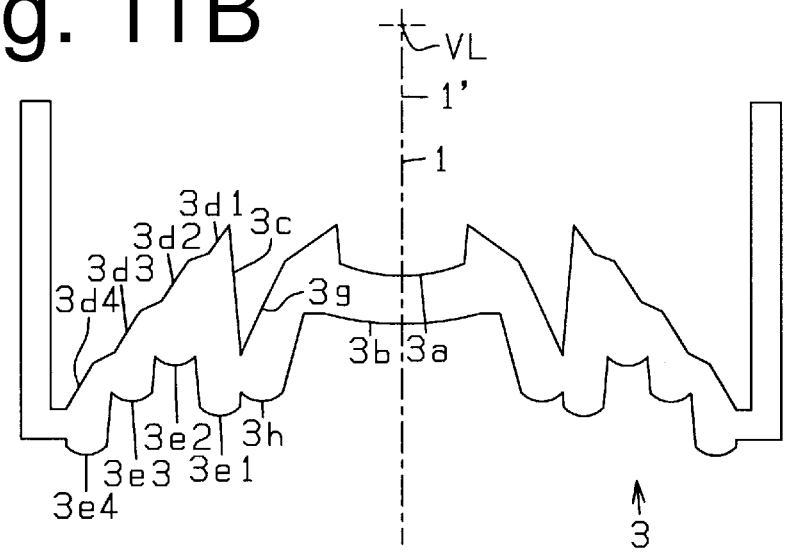

FIGS. 11A and 11B are enlarged diagrams mainly including a light guide lens 3 of a vehicle light 100 of a sixth exemplary embodiment. Specifically, FIG. 11A is an enlarged cross sectional view taken in a vertical direction including the optical axis 1' of the light emitting element light source 1. FIG. 11B is an enlarged cross sectional view taken in a horizontal direction including the optical axis 1'. In the vehicle light 100 of the first exemplary embodiment, the light exiting surface 3*e*1 can be formed from a flat surface obtained by rotating the segment "e1" perpendicular to the optical axis 1' of the light emitting element light source 1 around the optical axis 1' by 360 degrees (see FIG. 2B, for example). Instead, in the vehicle light 100 of the sixth exemplary embodiment, the light exiting surface 3*e*1 may be formed from a curved surface obtained by rotating a curve "e1" such as a circular arc around the optical axis 1' by 360 degrees (see FIG. 11A, for example).

Likewise, the light exiting surface 3*e*2 may be formed from a curved surface obtained by rotating a curve "e2" around the optical axis 1' by 360 degrees (see FIG. 11A, for example). The light exiting surface 3*e*3 may be formed from a curved surface obtained by rotating a curve "e3" around the optical axis 1' by 360 degrees (see FIG. 11A, for example). The light exiting surface 3*e*4 may be formed from a curved surface obtained by rotating a curve "e4" around the optical axis 1' by 360 degrees (see FIG. 11A, for example). The light exiting surface 3*h* may be formed from a curved surface obtained by rotating a curve "h" around the optical axis 1' by 360 degrees (see FIG. 11A, for example). In the vehicle light 100 of the sixth exemplary embodiment, these light exiting surfaces 3*e*1, 3*e*2, 3*e*3, 3*e*4, and 3*h* can serve as a lens cut.

Figure 12A:
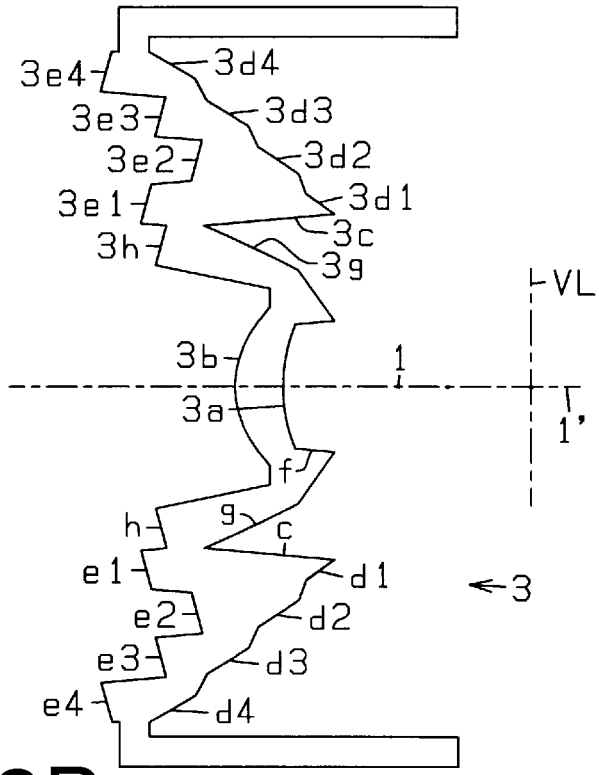
FIGS. 12A and 12B are an enlarged cross sectional view taken in a vertical direction and an enlarged cross sectional view taken in a horizontal direction, respectively, showing a light guide lens 3 of a vehicle light 100 according to a seventh exemplary embodiment.
Figure 12B:
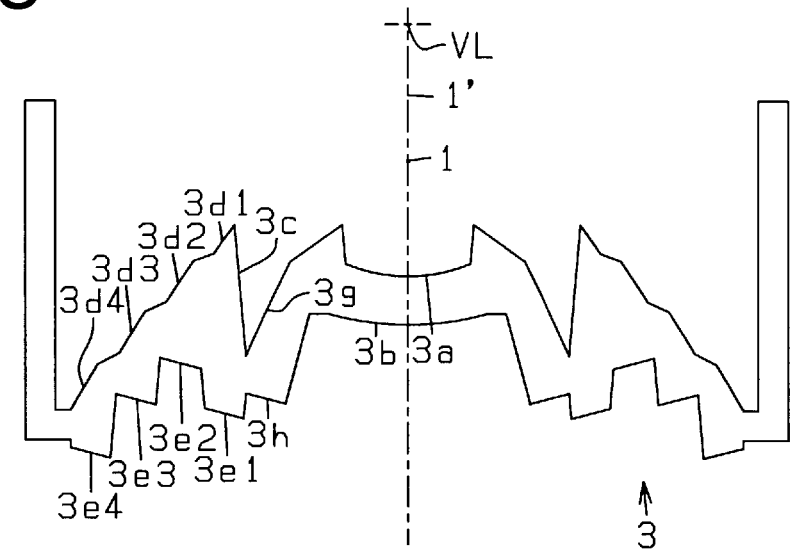

FIGS. 12A and 12B are enlarged diagrams mainly including a light guide lens 3 of a vehicle light 100 of a seventh exemplary embodiment. Specifically, FIG. 12A is an enlarged cross sectional view taken in a vertical direction including the optical axis 1' of the light emitting element light source 1. FIG. 12B is an enlarged cross sectional view taken in a horizontal direction including the optical axis 1'. In the vehicle light 100 of the first exemplary embodiment, the light exiting surface 3*e*1 can be formed from a flat surface obtained by rotating the segment "e1" perpendicular to the optical axis 1' of the light emitting element light source 1 around the optical axis 1' by 360 degrees (see FIG. 2B, for example). Instead, in the vehicle light 100 of the seventh exemplary embodiment, the light exiting surface 3*e*1 may be formed from a curved surface obtained by rotating an inclined segment "e1" by an acute angle with respect to a plane perpendicular to the optical axis 1' around the optical axis 1' by 360 degrees (see FIG. 12A, for example), so that the entire curved surface 3*e*1 can be a part of conical surface.

Likewise, the light exiting surface 3*e*2 may be formed from a curved surface obtained by rotating an inclined segment "e2" by an acute angle with respect to the plane perpendicular to the optical axis around the optical axis 1' by 360 degrees (see FIG. 12A, for example), so that the entire curved surface 3*e*2 can be a part of conical surface. The light exiting surface 3*e*3 may be formed from a curved surface obtained by rotating an inclined segment "e3" by an acute angle with respect to the plane perpendicular to the optical axis around the optical axis 1' by 360 degrees (see FIG. 12A, for example), so that the entire curved surface 3*e*3 can be a part of conical surface. Furthermore, the light exiting surface 3*e*4 may be formed from a curved surface obtained by rotating an inclined segment "e4" by an acute angle with respect to the plane perpendicular to the optical axis around the optical axis 1' by 360 degrees (see FIG. 12A, for example), so that the entire curved surface 3*e*4 can be a part of conical surface. The light exiting surface 3*h* may be formed from a curved surface obtained by rotating an inclined segment "h" by an acute angle with respect to the plane perpendicular to the optical axis around the optical axis 1' by 360 degrees (see FIG. 12A, for example), so that the entire curved surface 3*h* can be a part of conical surface. Accordingly, in the vehicle light 100 of the seventh exemplary embodiment, these light exiting surfaces 3*e*1, 3*e*2, 3*e*3, 3*e*4, and 3*h* can serve as a lens cut.

Any of light exiting surfaces 3*e*1, 3*e*2, 3*e*3, 3*e*4, and 3*h* of the vehicle light 100 of the sixth exemplary embodiment can appropriately be combined with any of light exiting surfaces 3*e*1, 3*e*2, 3*e*3, 3*e*4, and 3*h* of the vehicle light 100 of the seventh exemplary embodiment, that configuration serving as an eight exemplary embodiment.

Figure 13:
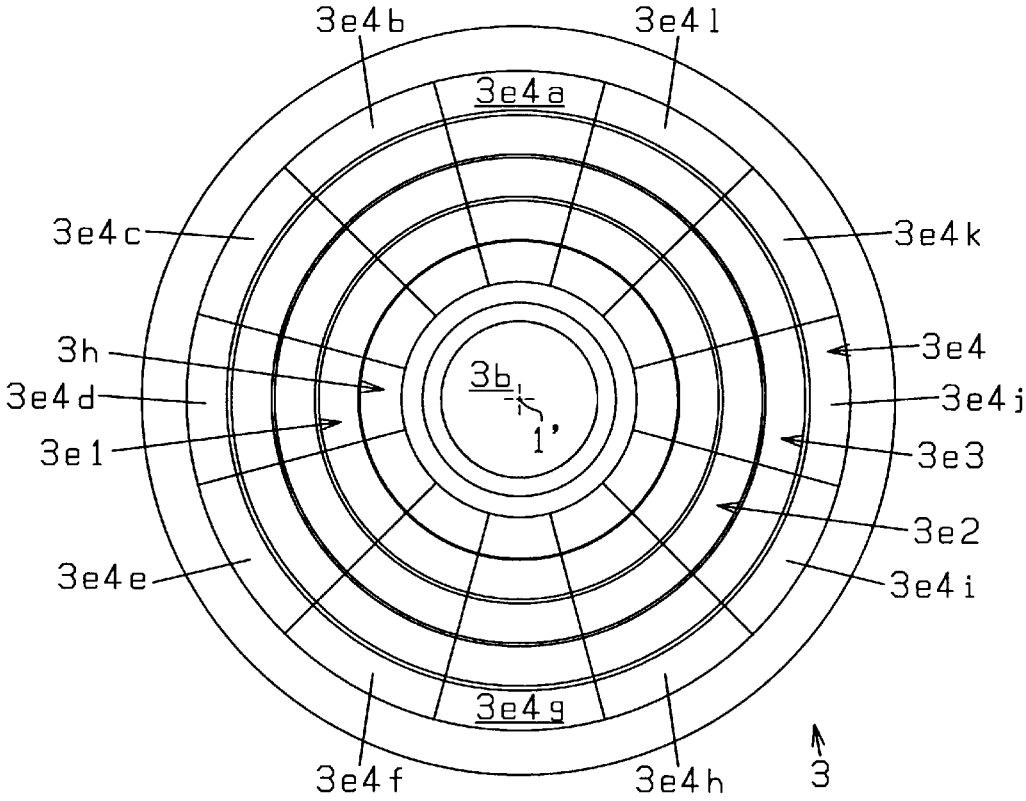
FIG. 13 is an enlarged front view of a light guide lens 3 of a vehicle light 100 according to a ninth exemplary embodiment.

FIG. 13 is an enlarged front view of a light guide lens 3 of a vehicle light 100 according to a ninth exemplary embodiment. In the vehicle light 100 of the first exemplary embodiment, the light exiting surface 3*e*4 can be formed from a single surface obtained by rotating the segment "e4" around the optical axis 1' by 360 degrees (see FIG. 2B, for example). In the vehicle light 100 of the ninth exemplary embodiment, instead, the ring-shaped light exiting surface 3*e*4 may be formed from a plurality of arc-shaped surfaces 3*e*4*a*, 3*e*4*b*, 3*e*4*c*, 3*e*4*d*, 3*e*4*e*, 3*e*4*f*, 3*e*4*g*, 3*e*4*h*, 3*e*4*i*, 3*e*4*j*, 3*e*4*k*, and 3*e*4*l*, each of which can be obtained by rotating a segment or a curve (not shown) around the optical axis 1' of the light emitting element light source 1 by an angle, for example, 30 degrees corresponding to the center angle of the arc, as shown in FIG. 13. Specifically, the plurality of arc-shaped surfaces 3*e*4*a*, 3*e*4*b*, 3*e*4*c*, 3*e*4*d*, 3*e*4*e*, 3*e*4*f*, 3*e*4*g*, 3*e*4*h*, 3*e*4*i*, 3*e*4*j*, 3e4k, and 3e4l constituting the ring-shaped light exiting surface 3e4 may be the same or different from one another.

Likewise, in the vehicle light 100 of the ninth exemplary embodiment, the light exiting surfaces 3e1, 3e2, 3e3, and 3h each may be formed from a plurality of arc-shaped surfaces that may be the same or different from one another. In this case, these arc-shaped surfaces 3e4a, 3e4b, 3e4c, 3e4d, 3e4e, 3e4f, 3e4g, 3e4h, 3e4i, 3e4j, 3e4k, and 3e4l can be formed by rotating a segment or curve by a certain angle so as to form a desired light distribution pattern, for example, a horizontally long light distribution pattern by light beams having passed through these light exiting surfaces 3e1, 3e2, 3e3, 3e4, and 3h.

Figure 14:
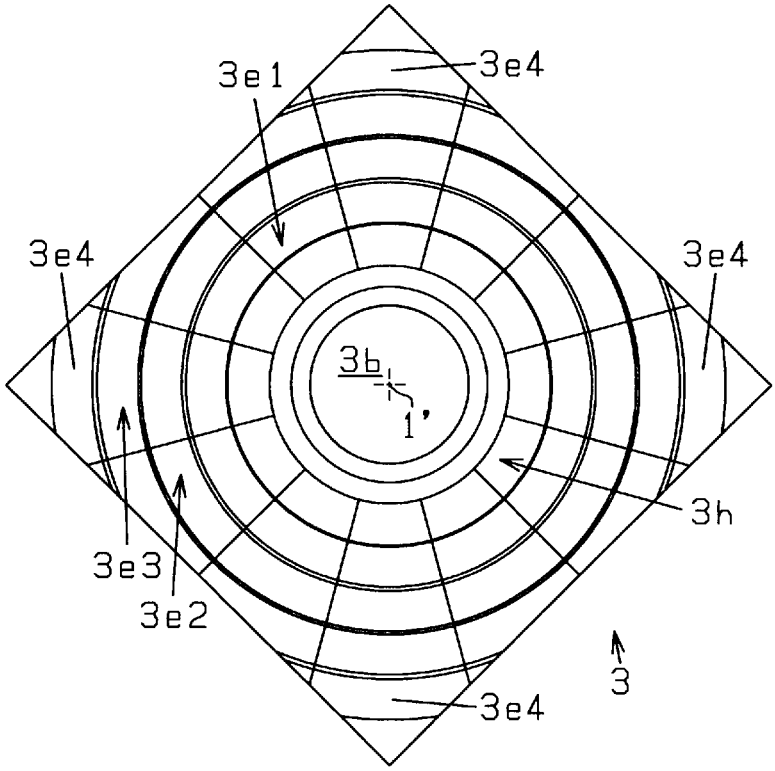
FIG. 14 is an enlarged front view of a light guide lens 3 of a vehicle light 100 according to a tenth exemplary embodiment.

FIG. 14 is an enlarged front view of a light guide lens 3 of a vehicle light 100 according to a tenth exemplary embodiment.

In the vehicle light 100 of the first exemplary embodiment, the ring-shaped light exiting surface 3h can be formed from a single surface obtained by rotating the segment "h" around the optical axis 1' by 360 degrees (see FIG. 2B, for example). In the vehicle light 100 of the tenth exemplary embodiment, instead, the ring-shaped light exiting surface 3h may be formed from a plurality of arc-shaped surfaces, each of which can be obtained by rotating a segment or a curve (not shown) around the optical axis 1' of the light emitting element light source 1 by an angle corresponding to the center angle of the arc, as shown in FIG. 14. Likewise, the ring-shaped light exiting surface 3e1 may be formed from a plurality of arc-shaped surfaces, each of which can be obtained by rotating a segment or a curve (not shown) around the optical axis 1' of the light emitting element light source 1 by an angle corresponding to the center angle of the arc, as shown in FIG. 14. The ring-shaped light exiting surfaces 3e2 and 3e3 can be formed from a plurality of arc-shaped surfaces in the same manner as the light exiting surface 3e1.

Furthermore, in the vehicle light 100 of the first exemplary embodiment, the light exiting surface 3e4 can be formed from a single surface obtained by rotating the segment "e4" around the optical axis 1' by 360 degrees (see FIG. 2B, for example). In the vehicle light 100 of the tenth exemplary embodiment, instead, the ring-shaped light exiting surface 3e4 may be formed from a plurality of arc-shaped surfaces, each of which can be obtained by rotating a segment or a curve (not shown) around the optical axis 1' of the light emitting element light source 1 by an angle corresponding to the center angle of the arc, as shown in FIG. 14. Furthermore, the light guide lens 3 including these incidence surfaces and light exiting surfaces may be a circular front shape or a rectangular front shape (which is shown in FIG. 14). Also in this case, the previous advantageous effects can be achieved.

Figure 15A:
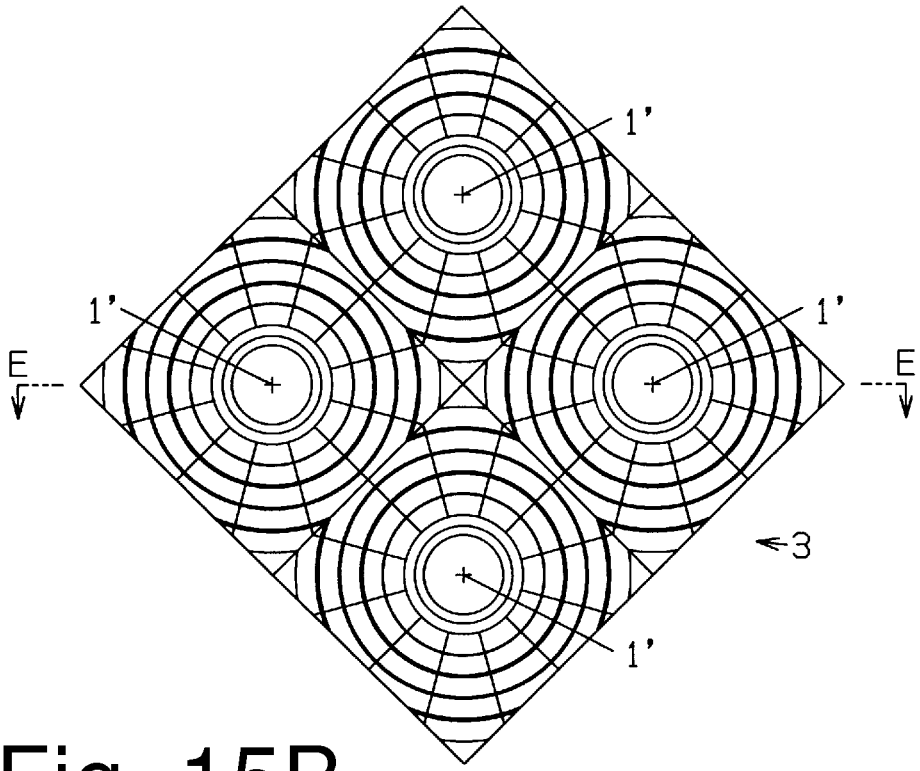
FIGS. 15A and 15B are a front view of a light guide lens 3 of a vehicle light 100 according to an eleventh exemplary embodiment and a cross sectional view of the same taken along line E-E in FIG. 15A, respectively.
Figure 15B:
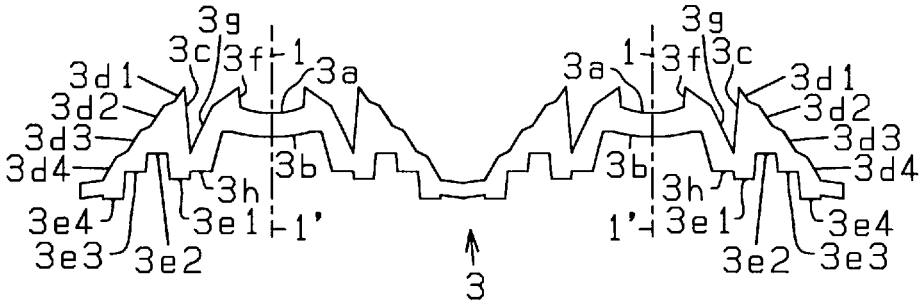

FIGS. 15A and 15B show a light guide lens 3 of a vehicle light 100 of an eleventh exemplary embodiment. Specifically, FIG. 15A is a front view of the light guide lens 3 of the vehicle light 100 according to the eleventh exemplary embodiment and FIG. 15B is a horizontal cross sectional view of the same taken along line E-E in FIG. 15A including the optical axis 1' of the light emitting element light source 1.

The vehicle light 100 of the tenth exemplary embodiment shown in FIG. 14 can include a single light emitting element light source 1 corresponding to the single light guide lens 3. Instead, in the vehicle light 100 of the eleventh exemplary embodiment, as shown in FIG. 15A, the single light guide lens 3 can be used for four light emitting element light sources 1. Specifically, the light guide lens 3 of the vehicle light 100 of the eleventh exemplary embodiment (as shown in FIG. 15) can be formed from four light guide lenses 3 of the tenth exemplary embodiment (as shown in FIG. 14) in combination. The thus obtained light guide lens 3 including these incidence surfaces and light exiting surfaces may be a rectangular front shape (which is shown in FIG. 15). Also in this case, the previous advantageous effects can be achieved.

Figure 16A:
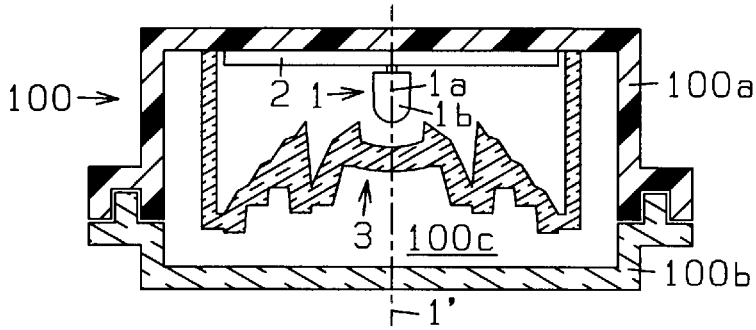
FIGS. 16A, 16B, and 16C are a cross sectional view of a vehicle light 100 according to a twelfth exemplary embodiment, a schematic cross sectional view of a light emitting element with light paths, and a schematic cross sectional view of the light emitting element with different light paths.
Figure 16B:
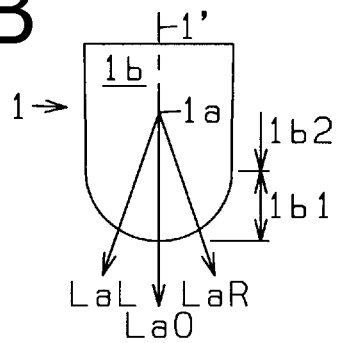
Figure 16C:
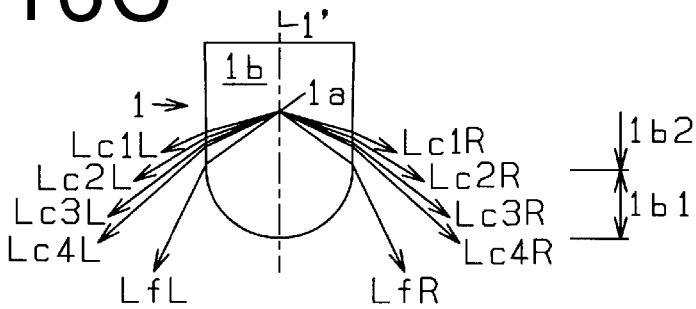

FIGS. 16A, 16B, and 16C show another vehicle light 100 according to a twelfth exemplary embodiment. Specifically, FIG. 16A is a horizontal cross sectional view of the vehicle light 100 according to the twelfth exemplary embodiment including the optical axis 1' of the light emitting element light source 1. FIG. 16B is a schematic cross sectional view of a light emitting element with light paths for light beams La0, LaL, and LaR within the horizontal sectional plane. FIG. 16C is a schematic cross sectional view of the same light emitting element as FIG. 16C with different light paths for different light beams Lc1L, Lc1R, Lc2L, Lc2R, Lc3L, Lc3R, Lc4L, Lc4R, LfL, and LfR within the horizontal sectional plane.

In the vehicle light 100 of the first exemplary embodiment, the light emitting element light source 1 can employ a chip type light emitting element as shown in FIGS. 1B and 1C. Instead, in the vehicle light 100 of the twelfth exemplary embodiment, the light emitting element light source can be an oval lamp type (or cannonball shape) light emitting element that includes a light emitting device and a sealing resin 1b for sealing the light emitting device 1a and has a shape of a spherical portion 1b1 and a cylindrical trunk portion 1b2 so as to be shaped into an approximately cannonball shape, as shown in FIGS. 16B and 16C.

Specifically, in the vehicle light 100 of the twelfth exemplary embodiment, light beams La0, LaL, and LaR exiting through the spherical portion 1b1 of the sealing resin 1b can impinge on the incidence surface 3a of the light guide lens 3 (see FIG. 4B, FIGS. 16A and 16B). Light beams LaU, and LaD exiting through the spherical portion 1b1 of the sealing resin 1b can impinge on the incidence surface 3a of the light guide lens 3 (see FIGS. 2B and 4A). Furthermore, light beams LfL, LfR, Lc1L, Lc1R, Lc2L, Lc2R, Lc3L, Lc3R, Lc4L, and Lc4R, exiting through the cylindrical trunk portion 1b2 of the sealing resin 1b can impinge on the incidence surface 3C and the incidence surface 3f of the light guide lens 3 (see FIG. 3 and FIGS. 4B, 5B, 6B, 7B, 8B, 9B, and FIGS. 16A and 16C). Additionally, light beams LfU, LfD, Lc1U, Lc1D, Lc2U, Lc2D, Lc3U, Lc3D, Lc4U, and Lc4D exiting through the cylindrical trunk portion 1b2 of the sealing resin 1b can impinge on the incidence surface 3C and the incidence surface 3f of the light guide lens 3 (see FIG. 3 and FIGS. 4A, 5A, 6A, 7A, 8A, 9A).

Accordingly, the vehicle light 100 of the twelfth exemplary embodiment can form a desired light distribution pattern satisfying a certain light distribution regulation, for example, a horizontally long light distribution pattern P shown in FIG. 10, by the main light beams La0, LaU, LaD, LaL, and LaR exiting through the spherical portion 1b1 of the sealing resin 1b of the light emitting element. Furthermore, the auxiliary light beams LfU, LfD, LfL, LfR, Lc1U, Lc1D, Lc1L, Lc1R, Lc2U, Lc2D, Lc2L, Lc2R, Lc3U, Lc3D, Lc3L, Lc3R, Lc4U, Lc4D, Lc4L, and Lc4R exiting through the cylindrical trunk portion 1b2 of the sealing resin 1b can be projected through the light exiting surfaces 3e1, 3e2, 3e3, 3e4, and 3h of the light guide lens 3 so that these light exiting surfaces 3e1, 3e2, 3e3, 3e4, and 3h can be observed as being illuminated.

The above described first to twelfth exemplary embodiments can be appropriately combined with one another to constitute other exemplary embodiments.

Furthermore, the vehicle light according to the presently disclosed subject matter can be applied to a vehicle light such as a stop lamp, a tail lamp, a high-mount lamp, a signal lamp and the like.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light comprising:

a light emitting element configured to act as a light source and having an optical axis; and a light guide lens configured to guide light beams from the light emitting element, so as to project light in an illumination direction of the vehicle light, the light guide lens including a first incidence surface, a second incidence surface, a first protruding light exiting surface, a plurality of first reflection surfaces, and a plurality of second light exiting surfaces, wherein:

the first incidence surface is configured to receive light beams emitted from the light emitting element at an angle of from 0 degrees to θ1 degrees (where $0<\theta1$) with respect to the optical axis;

the second incidence surface is configured to receive light beams emitted from the light emitting element at an angle of from θ4 degrees to θ5 degrees (where $\theta1<\theta4<\theta5$) with respect to the optical axis;

the first protruding light exiting surface is configured to allow the light beams having passed through the first incidence surface to exit the light guide lens through the first protruding light exiting surface in the illumination direction of the vehicle light;

the plurality of first reflection surfaces are configured to reflect the light beams having passed through the second incidence surface so that the reflected light beams are substantially parallel with the optical axis;

the plurality of second light exiting surfaces are each configured to be one of a ring-shaped surface and an arc-shaped surface, and configured to allow the reflected light beams from the plurality of first reflection surfaces to exit in the illumination direction of the vehicle light;

the plurality of first reflection surfaces are disposed in a stepped manner, and the plurality of second light exiting surfaces are disposed in a stepped manner;

light beams emitted from the light emitting element at an angle of from θ4 degrees to θ4a degrees (where $\theta4<\theta4a<\theta5$) with respect to the optical axis of the light emitting element impinge on the second incidence surface, and then the light beams are reflected by the farthest first reflection surface among the plurality of first reflection surfaces with respect to the optical axis, and exit through the farthest ring-shaped or arc-shaped second light exiting surface among the plurality of second light exiting surfaces with respect to the optical axis;

light beams emitted from the light emitting element at an angle of from θ4c degrees to θ5 degrees (where $\theta4a<\theta4c<\theta5$) with respect to the optical axis of the light emitting element impinge on the second incidence surface, and then the light beams are reflected by the first reflection surface nearest to the optical axis among the plurality of first reflection surfaces, and exit through the nearest ring-shaped or arc-shaped second light exiting surface among the plurality of second light exiting surfaces with respect to the optical axis;

the vehicle light further comprises a third incidence surface formed between the first incidence surface and the second incidence surface, the third incidence surface configured to receive light beams emitted from the light emitting element at an angle of from θ2 degrees to θ3 degrees (where $\theta1\leq\theta2<\theta3\leq\theta4$) with respect to the optical axis of the light emitting element, a second reflection surface disposed nearer to the optical axis of the light emitting element than the second incidence surface and the plurality of first incidence surfaces, the second reflection surface configured to reflect the light beams having passed through the third incidence surface so that the reflected light beams are substantially parallel with the optical axis, a third light exiting surface disposed between the first light exiting surface and the plurality of ring-shaped or arc-shaped second light exiting surfaces, the third light exiting surface configured to be a ring-shaped surface or an arch-shaped surface, and to allow the reflected light beams from the second reflection surface to exit through the third light exiting surface in the illumination direction of the vehicle light; wherein the vehicle light is configured such that a curvature of the first light exiting surface in a plane including the direction between a third side and a fourth side and including the optical axis is made smaller than a curvature of the first light exiting surface in a plane including the direction between the first side and the second side and including the optical axis so that:

when light beams that are emitted toward the first side at an angle of θ1a degrees (where $0<\theta1a<\theta1$) with respect to the optical axis of the light emitting element pass through the first incidence surface and the first light exiting surface, the light beams exit the light guide lens toward the first side at an angle of θ1b degrees (where $0<\theta1b<\theta1a$) with respect to the optical axis of the light emitting element;

when light beams that are emitted toward the second side opposite to the first side with respect to the optical axis at the angle of θ1a degrees with respect to the optical axis of the light emitting element pass through the first incidence surface and the first light exiting surface, the light beams exit the light guide lens toward the second side at the angle of θ1b degrees with respect to the optical axis of the light emitting element;

when light beams that are emitted toward the third side with respect to the first and second sides by 90 degrees around the optical axis at the angle of θ1a degrees with respect to the optical axis of the light emitting element pass through the first incidence surface and the first light exiting surface, the light beams exit the light guide lens toward the third side at the angle of θ1c degrees (where $\theta1b<\theta1c$) with respect to the optical axis of the light emitting element; and when light beams that are emitted toward the fourth side opposite to the third side with respect to the optical axis (for example, rightward) at the angle of θ1a degrees with respect to the optical axis of the light emitting element pass through the first incidence surface and the first light exiting surface, the light beams exit the light guide lens toward the fourth side at the angle of θ1c degrees with respect to the optical axis of the light emitting element;

the vehicle light projects the light beams emitted from the light emitting element at an angle of from θ2 degrees to θ3 degrees with respect to the optical axis of the light emitting element so that the ring-shaped or arc-shaped third light exiting surface nearest to the optical axis among the plurality of ring-shaped or arc-shaped second and third light exiting surfaces is the brightest; and the vehicle light projects the light beams emitted from the light emitting element at an angle of from θ4 degrees to θ4a degrees with respect to the optical axis of the light emitting element so that the ring-shaped or arc-shaped second light exiting surface farthest from the optical axis among the plurality of ring-shaped or arc-shaped second and third light exiting surfaces is the second brightest.

2. The vehicle light according to claim 1, wherein:

the second incidence surface is configured such that the angle formed by the light beams passing through the second incidence surface and the optical axis of the light emitting element is larger than the angle formed by the light beams that impinge on the second incidence surface and the optical axis; and the third incidence surface is configured such that the angle formed by the light beams passing through the third incidence surface and the optical axis of the light emitting element is larger than the angle formed by the light beams that impinge on the third incidence surface and the optical axis.

3. The vehicle light according to claim 1, wherein:

the plurality of second and third light exiting surfaces each include a plurality of arc-shaped surfaces; and each of the arc-shaped surfaces is formed by rotating a specific segment or curve segment around the optical axis of the light emitting element by a required angle as a center angle of the arc shape so that the light beams having passed through the plurality of second and third light exiting surfaces form an elongated light distribution pattern.

4. The vehicle light according to claim 2, wherein:

the plurality of second and third light exiting surfaces each include a plurality of arc-shaped surfaces; and each of the arc-shaped surfaces is formed by rotating a specific segment or curve segment around the optical axis of the light emitting element by a required angle as a center angle of the arc shape so that the light beams having passed through the plurality of second and third light exiting surfaces form an elongated light distribution pattern.

5. The vehicle light according to claim 1, wherein:

the light emitting element serving as a light source is an oval lamp type light emitting element that includes a light emitting device and a sealing resin for sealing the light emitting device and has a shape of a spherical portion and a cylindrical trunk portion so as to be shaped into an approximate cannonball shape, light beams exiting through the spherical portion of the sealing resin during operation of the light emitting element impinge on the first incidence surface of the light guide lens, and light beams exiting through the cylindrical trunk portion during operation of the light emitting element impinge on the second incidence surface and the third incidence surface of the light guide lens.

6. The vehicle light according to claim 2, wherein:

the light emitting element serving as a light source is an oval lamp type light emitting element that includes a light emitting device and a sealing resin for sealing the light emitting device and has a shape of a spherical portion and a cylindrical trunk portion so as to be shaped into an approximate cannonball shape, light beams exiting through the spherical portion of the sealing resin during operation of the light emitting element impinge on the first incidence surface of the light guide lens, and light beams exiting through the cylindrical trunk portion during operation of the light emitting element impinge on the second incidence surface and the third incidence surface of the light guide lens.

7. The vehicle light according to claim 3, wherein:

the light emitting element serving as a light source is an oval lamp type light emitting element that includes a light emitting device and a sealing resin for sealing the light emitting device and has a shape of a spherical portion and a cylindrical trunk portion so as to be shaped into an approximate cannonball shape, light beams exiting through the spherical portion of the sealing resin during operation of the light emitting element impinge on the first incidence surface of the light guide lens, and light beams exiting through the cylindrical trunk portion during operation of the light emitting element impinge on the second incidence surface and the third incidence surface of the light guide lens.

8. The vehicle light according to claim 4, wherein:

the light emitting element serving as a light source is an oval lamp type light emitting element that includes a light emitting device and a sealing resin for sealing the light emitting device and has a shape of a spherical portion and a cylindrical trunk portion so as to be shaped into an approximate cannonball shape, light beams exiting through the spherical portion of the sealing resin during operation of the light emitting element impinge on the first incidence surface of the light guide lens, and light beams exiting through the cylindrical trunk portion during operation of the light emitting element impinge on the second incidence surface and the third incidence surface of the light guide lens.

* * * * *